US011162199B2

(12) United States Patent
Yasumoto et al.

(10) Patent No.: US 11,162,199 B2
(45) Date of Patent: Nov. 2, 2021

(54) SEWING MACHINE

(71) Applicant: JANOME SEWING MACHINE CO., LTD., Tokyo (JP)

(72) Inventors: Saki Yasumoto, Tokyo (JP); Shuichi Sato, Tokyo (JP); Yoshihiro Sakai, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 92 days.

(21) Appl. No.: 16/852,101

(22) Filed: Apr. 17, 2020

(65) Prior Publication Data

US 2020/0399807 A1 Dec. 24, 2020

(30) Foreign Application Priority Data

Jun. 20, 2019 (JP) ..... JP2019-114996

(51) Int. Cl.
*D05B 73/12* (2006.01)
*D05B 69/02* (2006.01)
*D05B 69/30* (2006.01)

(52) U.S. Cl.
CPC ..... *D05B 73/12* (2013.01); *D05B 69/02* (2013.01); *D05B 69/30* (2013.01)

(58) Field of Classification Search
CPC ..... D05B 73/12; D05B 69/02; D05B 69/04; D05B 69/30; D05D 2207/05; D05D 2207/06
USPC ..... 112/260
See application file for complete search history.

(56) References Cited

U.S. PATENT DOCUMENTS 4,493,280 A * 1/1985 Bianchi ..... D05B 73/12 112/260
2010/0212563 A1* 8/2010 Mizuno ..... D05B 27/02 112/260
2016/0040342 A1* 2/2016 Maeda ..... D05B 73/12 112/260
2019/0352825 A1* 11/2019 Yanagisawa ..... D05B 73/005
2019/0352826 A1* 11/2019 Ishikawa ..... D05B 73/005
(Continued)

FOREIGN PATENT DOCUMENTS

JP 2013-48846 A 3/2013

*Primary Examiner* — Nathan E Durham
(74) *Attorney, Agent, or Firm* — Nakanishi IP Associates, LLC

(57) ABSTRACT

A needle plate attaching/detaching mechanism includes: a needle plate fixing portion rotatably provided below a needle plate mounted on a sewing machine main body, and movable between a fixed position fixing the needle plate to the sewing machine main body and a non-fixed position where the fixing is released; a driving gear jointly rotatably coupled to the needle plate fixing portion; a transmission mechanism switchable between a transmission state transmitting driving force from a motor to the driving gear and a disconnection state disconnecting the transmission; and an operating member including a manual gear transmitting manual operating force to the driving gear. When the operating member is non-operating, the transmission mechanism is set to the transmission state, and the manual gear is disconnected from the driving gear. In the operating state, the operating member switches the transmission mechanism from transmission to disconnection, and the manual and driving gears are coupled.

4 Claims, 9 Drawing Sheets

(56) References Cited

U.S. PATENT DOCUMENTS

2019/0352827 A1* 11/2019 Ishikawa ..... D05B 73/005
2020/0010993 A1* 1/2020 Ueda ..... D05B 27/24

* cited by examiner

SEWING MACHINE

CROSS REFERENCE TO RELATED APPLICATION

This application claims priority to Japanese Patent Application No. 2019-114996 filed on Jun. 20, 2019, the entire content of which is incorporated by reference.

BACKGROUND OF THE INVENTION

1. Field of the Invention

The present invention relates to a sewing machine.

2. Description of the Related Art

With a needle plate attaching/detaching mechanism employed in a sewing machine described in Patent document 1 listed below, a needle plate is fixed to a bed portion of the sewing machine by a plate spring. The needle attaching/detaching mechanism includes a positioning pin and an operating lever in order to release a needle plate fixed state. With such an arrangement, upon operating the operating lever, the operating lever lifts the needle plate via the positioning pin so as to release the needle plate fixed state provided by the plate spring.

RELATED ART DOCUMENTS

Patent Documents

Patent Document 1

Japanese Patent Application Laid Open No. 2013-48846

Here, for example, in a case in which the needle plate attaching/detaching mechanism is configured to be switched by the driving operation of a motor to the needle plate fixed state in which the needle plate is fixed or a release state in which the needle plate fixed state is released, such an arrangement provides improved convenience for the user.

However, let us consider an arrangement in which the needle plate attaching/detaching mechanism has the same configuration as that including a release portion (operating lever) in addition to a fixing portion (plate spring) described in the aforementioned Patent document 1 except that the release unit is motorized. Such an arrangement allows the needle plate to be automatically detached by electric power. However, it is difficult for such an arrangement to automatically attach the needle plate using electric power. In a case of supporting both the needle plate attaching function and the needle plate detaching function as a motorized function using electric power, the fixing portion is required to be configured such that it is shifted between a fixed position at which the needle plate is fixed and a non-fixed position by the motor driving operation.

However, with such a needle plate attaching/detaching mechanism configured to operate by a motor driving operation, for example, from the viewpoint of providing safety at the time of an emergency situation such as a malfunction of the motor, the needle plate attaching/detaching mechanism is preferably configured to allow the user to operate it manually.

SUMMARY OF THE INVENTION

One or more embodiments of the present invention the present invention to provide a needle plate attaching/detaching mechanism that provides improved convenience for the user and that ensures safety in an emergency situation, and a sewing machine including such a needle plate attaching/detaching mechanism.

At least one embodiment of the present invention proposes a sewing machine including a needle plate attaching/detaching mechanism. The needle plate attaching/detaching mechanism includes: a needle plate fixing portion rotatably provided below a needle plate mounted on a sewing machine main body, and configured such that it can be moved between a fixed position at which the needle plate is fixed to the sewing machine main body and a non-fixed position at which the fixed state of the needle plate is released; a driving gear coupled to the needle plate fixing portion such that they can be rotated as a single unit; a motor having an output shaft to which a motor gear is provided such that they can be rotated as a single unit; a transmission mechanism configured to be switchable between a transmission state in which a driving force from the motor is transmitted to the driving gear and a disconnection state in which the transmission is disconnected; and an operating member including a manual gear configured to transmit a manual operating force to the driving gear. When the operating member is not operated, the transmission mechanism is set to the transmission state, and the manual gear is disconnected from the driving gear. When the operation member is operated, the operating member switches the transmission mechanism from the transmission state to the disconnection state, and the manual gear is coupled to the driving gear.

At least one embodiment of the present invention also proposes the sewing machine. The transmission mechanism includes: a first gear that meshes with the motor gear; and a second gear coupled to the first gear such that they can be rotated as a single unit, and arranged such that it meshes with the driving gear. The manual gear includes: a gear portion configured such that it is able to mesh with the second gear; and an incomplete gear portion configured to avoid meshing with the second gear. When the operating member is in a non-operating state, the incomplete gear portion provides the disconnection state in which the manual gear is disconnected from the driving gear.

At least one embodiment of the present invention also proposes the sewing machine. The transmission mechanism includes a clutch mechanism configured to couple the first gear and the second gear such that they can be rotated as a single unit. When the operating member is operated, the operating member operates the clutch mechanism so as to release a coupling state between the first gear and the second gear.

At least one embodiment of the present invention also proposes the sewing machine. The clutch mechanism includes a fitting portion provided to the first gear and a fitting target portion provided to the second gear. When the operating member is operated such that it is pressed, the manual gear presses the second gear so as to release a fitting state between the fitting portion and the fitting target portion. The fitting portion is fitted within the fitting target portion only when a rotational position relation between the first gear and the second gear is set to a relation provided before the operation of the clutch mechanism.

The sewing machine having the configuration described above is capable of ensuring safety in an emergency situation while providing improved convenience for the user.

DESCRIPTION OF THE PREFERRED EMBODIMENTS

Figure 1:
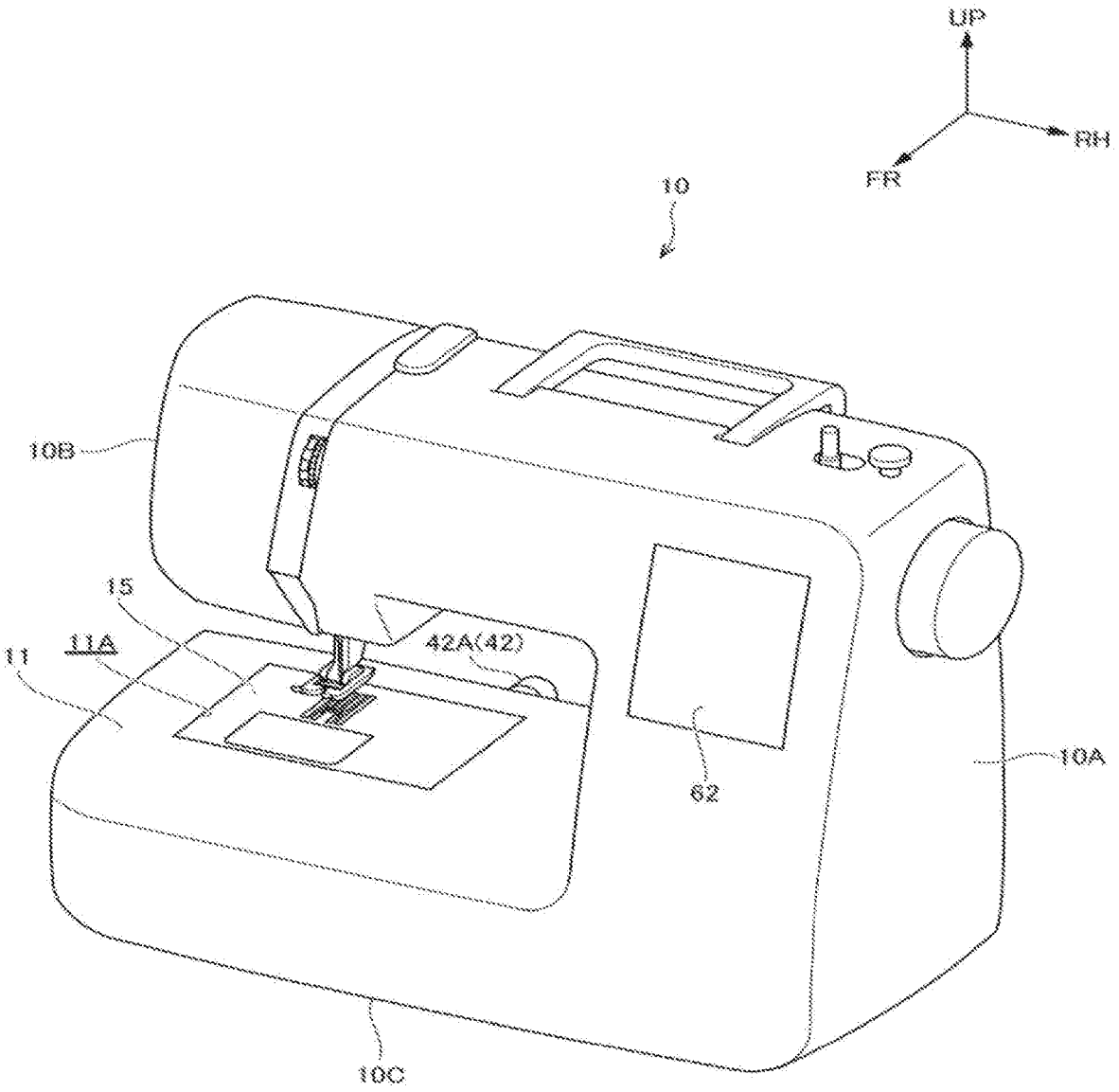
FIG. 1 is a perspective view showing a sewing machine employing a needle plate attaching/detaching mechanism according to the present embodiment as viewed diagonally from the right side and the front side.

Description will be made below with reference to the drawings regarding a sewing machine 10 configured as an application including a needle plate attaching/detaching mechanism 18 according to the present embodiment. It should be noted that, in the drawings, the arrow UP shown as appropriate indicates the upper side of the sewing machine 10, the arrow FR indicates the front side of the sewing machine 10, and the arrow RH indicates the right side (one side in the width direction).

As shown in FIG. 1, as an overall structure, the sewing machine 10 has an approximately U-shaped structure having an opening that faces the left side in a front view as viewed from the front side. Specifically, the sewing machine 10 includes: a pillar portion 10A that forms the right end portion of the sewing machine 10 and that is configured such that it extends in the upper-lower direction; an arm portion 10B configured such that it extends from the upper end portion of the pillar portion 10A toward the left side; and a bed portion 10C configured as a "sewing machine main body" such that it extends from the lower end portion of the pillar portion 10A toward the left side. Furthermore, the sewing machine 10 includes, as an internal component thereof, a framework (not shown) that forms a skeleton of the sewing machine 10.

The sewing machine 10 includes a needle plate 15 provided to the upper-left portion of the bed portion 10C, a needle plate attaching/detaching mechanism 18 (see FIG. 2) configured to detachably fix the needle plate 15 to the bed portion 10C, and a control unit 60 (see FIG. 3) configured to control the operation of the needle plate attaching/detaching mechanism 18. With such an arrangement, upon operating the needle plate attaching/detaching mechanism 18, this releases the fixed state of the needle plate 15, thereby allowing the needle plate 15 to be detached from the bed portion 10C. Description will be made below regarding each component of the sewing machine 10.

[Regarding the Bed Portion 10C]

The bed portion 10C includes a cover 11 that forms a housing of the bed portion 10C. The framework is covered by the cover 11. A hole portion 11A is formed as a through hole in the upper wall of the cover 11 in order to allow the needle plate 15 described later to be attached. In a plan view, the hole portion 11A is formed in an approximately rectangular shape with the left-right direction as its longitudinal direction.

Figure 2:
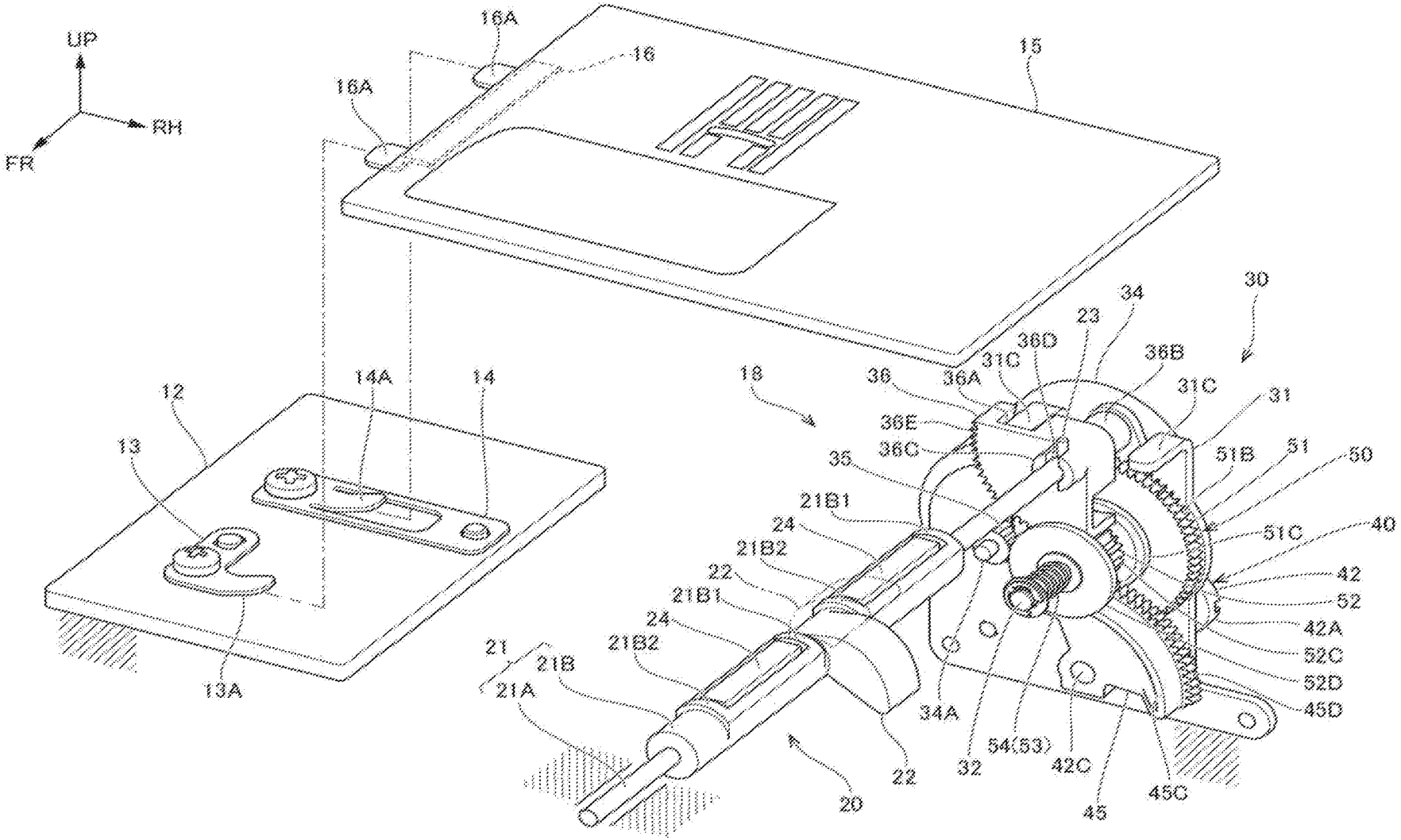
FIG. 2 is a perspective view showing a fixing plate and the needle plate detaching mechanism arranged in a bed portion shown in FIG. 1 as viewed diagonally from the right side and the front side.

As shown in FIG. 2, a fixing plate 12 is provided within the bed portion 10C such that it is positioned on the left side of the hole portion 11A formed in the cover 11 (not shown in FIG. 2). The fixing plate 12 is formed in an approximately rectangular plate shape with the upper-lower direction as its thickness direction. The fixing plate 12 is fixedly coupled to the framework. A plate-shaped first presser member 13 and a second presser member 14 are provided on the upper face of the fixing plate 12. The first presser member 13 and the second presser member 14 are arranged side by side in the front-rear direction with the upper-lower direction as their thickness directions. The first presser member 13 and the second presser member 14 are each fixed to the fixing plate 12 by screwing. A presser tab 13A is integrally formed in the first presser member 13. The presser tab 13A is configured such that it is inclined upward toward the right side. Furthermore, a presser tab 14A having the same structure as that of the presser tab 13A is integrally formed in the second presser member 14. The presser tab 14A is configured such that it is inclined upward toward the right side.

[Regarding the Needle Plate 15]

The needle plate 15 is formed of a metal material such as iron, cobalt, nickel, an alloy thereof, or a magnetic material such as ferrite or the like. The needle plate 15 is configured in an approximately rectangular plate shape with the upper-lower direction as its thickness direction. The needle plate 15 is arranged within the hole portion 11A of the cover 11 (see FIG. 1). An engagement member 16 is provided to the lower face of the left-end portion of the needle plate 15. The engagement member 16 is configured in an approximately longitudinal plate shape such that it extends in the front-rear direction. The engagement member 16 is fixed to the needle plate 15 by screwing. A pair of front and rear engagement tabs 16A are integrally formed in both ends of the engagement member 16 in the longitudinal direction. Each engagement tab 16A is configured such that it extends from the engagement member 16 downward and toward the left side in an approximately crank shape. With such an arrangement, the end portions of the engagement tabs 16A are respectively inserted from the right side into a gap between the fixing plate 12 and the presser tab 13A of the first presser member 13 and a gap between the fixing plate 12 and the presser tab 14A of the second presser 14. In this state, the engagement tabs 16A are engaged with the presser tabs 13A and 14A, respectively. With this, the left end portion of the needle plate 15 is fixed to the fixing plate 12 via the engagement member 16.

[Regarding the Needle Plate Attaching/Detaching Mechanism 18]

Figure 3:
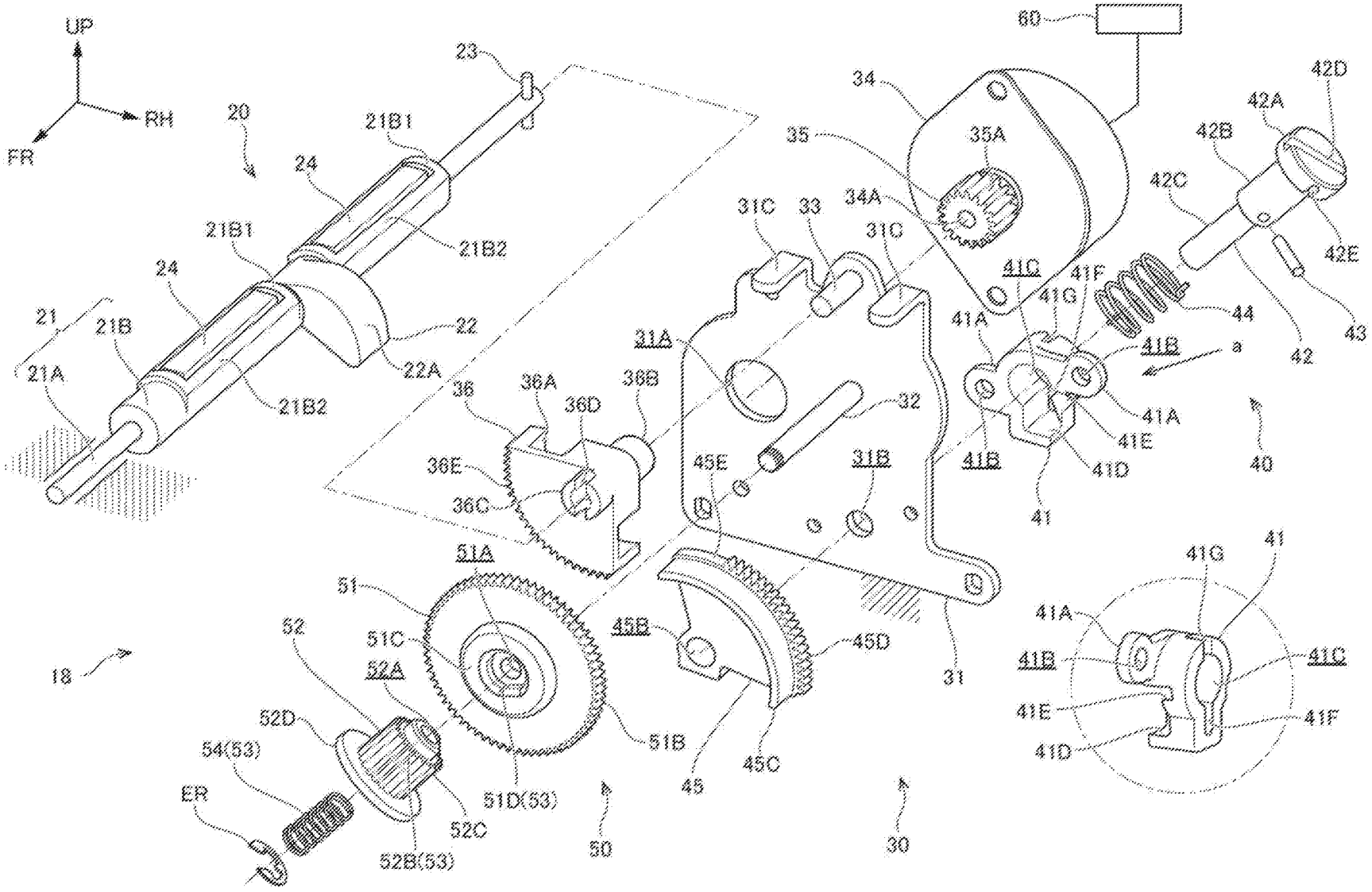
FIG. 3 is an exploded perspective view showing the needle plate attaching/detaching mechanism shown in FIG. 3.

Next, description will be made regarding the needle plate attaching/detaching mechanism 18 configured as a main unit of the present invention. As shown in FIGS. 2 and 3, the needle plate attaching/detaching mechanism 18 is configured including an attaching/detaching bar 20 configured as a "needle fixing portion" configured to allow the needle plate 15 to be attached and detached to and from the bed portion 10C, and a driving mechanism 30 configured to rotationally drive the attaching/detaching bar 20. The needle plate attaching/detaching mechanism 18 is arranged within the bed portion 10C.

[Regarding the Attaching/Detaching Bar 20]

As shown in FIG. 4, the attaching/detaching bar 20 is configured including a rotational shaft 21, a cam 22, and a pair of magnets 24.

The rotational shaft 21 is arranged below the right end portion of the needle plate 15 with the front-rear direction as its axial direction. The rotational shaft 21 is configured including a core portion 21A configured in an approximately round-bar shape that forms the shaft core portion of the rotational shaft 21, and an outer shaft portion 21B configured in an approximately cylindrical shape provided to the outer circumferential portion of the core portion 21A. Furthermore, in the present embodiment, the core portion 21A is formed of a metal material. In contrast, the outer shaft portion 21B is formed of a resin (POM, for example). The core portion 21A and the outer shaft portion 21B are integrally formed by insert molding or the like. Specifically, the outer shaft portion 21B is integrally formed together with the core portion 21A such that the outer shaft portion 21B covers an intermediate portion of the core portion 21A along the axial direction. With such an arrangement, the front end portion of the core portion 21A is rotatably supported by the framework. Furthermore, a coupling pin 23 is integrally and rotatably formed in the rear end portion of the core portion 21A. The coupling pin 23 is configured in an approximately cylindrical shape with the upper-lower direction as its axial direction such that it protrudes from the core portion 21A toward the upper side and the lower side. Furthermore, the coupling pin 23 is configured such that its axis crosses the axis of the core portion 21A. With such an arrangement, the rear end portion of the core portion 21A is coupled to a driving gear 36 of the driving mechanism 30 described later such that they can be rotated as a single unit.

The cam 22 is integrally provided to an intermediate portion of the outer shaft portion 21B along the longitudinal direction thereof. In a front view, the cam 22 is configured in an approximately semi-elliptical shape such that it protrudes from the outer circumferential portion of the outer shaft portion 21B diagonally rearward and downward. Specifically, in a front view, the cam 22 has a cam face 22A convexly curved such that it protrudes diagonally rightward and upward. The cam 22 is configured such that the distance between the axis of the rotational shaft 21 and the cam face 22A becomes larger closer to the end side from the base side of the cam face 22A. With such an arrangement, the cam 22 is arranged such that the base end portion of the cam face 22A is in the vicinity of the lower side of the needle plate (specifically, in the vicinity of the lower side thereof with a gap to some extent).

Furthermore, a pair of front and rear protrusions 21B1 are formed in the rotational shaft 21 on both sides of the cam 22 along the axial direction of the rotational shaft 21 such that they protrude upward. Each protrusion 21B1 has an upper face configured as a receiving face 21B2. As viewed in the axial direction of the rotational shaft 21, the receiving face 21B2 is configured as an arc-shaped face curved with the axis of the core portion 21A (rotational shaft 21) as the center (see the expanded partial view in FIG. 4A). With such an arrangement, in a state in which the needle plate 15 is fixed, the lower face of the needle plate is in contact with the receiving face 21B2 (the state shown in FIG. 4A, and this position will be referred to as a "fixed position" provided by the attaching/detaching bar 20).

A pair of magnets 24 are each configured as an approximately rectangular pillar shape with the axial direction of the rotational shaft 21 as its longitudinal direction. The magnets 24 are arranged on the front side and on the rear side of the cam 22, respectively. Each magnet 24 is embedded in the corresponding protrusion 21B1 of the outer shaft portion 21B in a state in which the upper face thereof is exposed as an external component of the rotational shaft 21. With this, the magnets 24 and the rotational shaft 21 are configured such that they can be rotated as a single unit. In the fixed position of the rotational shaft 21, the magnets 24 are arranged such that the upper face of each magnet 24 faces the lower face of the needle plate 15 in the upper-lower direction with a predetermined gap between them (see the expanded partial view in FIG. 4A). With this, the needle plate 15 is forced downward by the magnetic force of the magnets 24.

Accordingly, in the fixed position provided by the rotational shaft 21, the needle plate 15 is fixed to the bed portion 10C.

Furthermore, although detailed description thereof will be provided later, when the rotational shaft 21 is rotated from the fixed position toward one side in the rotational direction (toward the side in the direction indicated by the arrow C in FIG. 4A), the magnets 24 are each displaced downward and leftward with respect to the needle plate 15, and the cam 22 is displaced such that it protrudes upward from the rotational shaft 21. With this, the cam 22 (the cam face 22 of the cam 22) lifts the needle plate 15 upward, thereby releasing the fixed state of the needle plate 15 provided by the magnets 24 (the position shown in FIG. 4B, which will be referred to as a "non-fixed position" provided by the attaching/detaching bar 20).

[Regarding the Driving Mechanism 30]

As shown in FIGS. 2, 3, 5, and 6, the driving mechanism 30 is configured including a base plate 31, a needle plate motor 34 configured as a motor, a driving gear 36, a transmission mechanism 50, and an operating mechanism 40.

[Regarding the Base Plate 31]

A base plate 31 is configured in an approximately rectangular plate shape with the front-rear direction as its thickness direction. The base plate 31 is fixed to the framework of the sewing machine 10. A first shaft 32 is provided at an approximately central portion of the base plate 31. The first shaft 32 is configured in an approximately cylindrical shape with the front-rear direction as its axial direction such that it protrudes toward the front side from the base plate 31. Furthermore, a second shaft 33 is provided to the base plate 31 such that it is positioned on the upper side of the first shaft 32.

The second shaft 33 is configured in an approximately cylindrical shape with the front-rear direction as its axial direction such that it protrudes from the base plate 31 toward the front side.

Furthermore, a first insertion hole 31A is formed as a circular through hole in the base plate 31 such that it is positioned on the left side of the first shaft 32.

Furthermore, a second insertion hole 31B is formed as a through hole in the base plate 31 such that it is positioned diagonally downward and rightward from the first shaft 32. Furthermore, a pair of front and rear guide tabs 31C are formed in the upper end portion of the base plate 31. Each guide tab 31C is configured such that it is bent at a right angle such that it extends toward the front side.

[Regarding the Needle Plate Motor 34]

The needle plate motor 34 is arranged adjacent to the rear side of the left-side portion of the base plate 31 with the front-rear direction as its axial direction. The needle plate motor 34 is fixedly mounted on the base plate 31. With such an arrangement, an output shaft 34A of the needle plate motor 34 is arranged such that it passes through the first insertion hole 31A and such that it protrudes toward the front side from the base plate 31. A motor gear 35 having an approximately cylindrical shape is provided to the output shaft 34A of the needle plate motor 34 such that they can be rotated as a single unit. A gear portion 35A is formed as multiple gear teeth in the outer circumferential portion of the motor gear 35.

[Regarding the Driving Gear 36]

The driving gear 36 is configured in an approximately fan-shaped plate shape with the front-rear direction as its thickness direction. Specifically, in a front view, the driving gear 36 is configured in an approximately quadrant shape arranged such that it protrudes diagonally downward and leftward. Furthermore, a guide groove 36A is formed in the rear face of the driving gear 36 such that it is positioned at an intermediate portion in its radial direction and such that it has an opening that faces the rear side. The guide groove 36A is configured such that it extends along the circumferential direction of the driving gear 36. A support shaft portion 36B is integrally formed in the base end portion of the driving gear 36. The support shaft portion 36B is configured in an approximately cylindrical shape with the front-rear direction as its axial direction such that it protrudes rearward from the driving gear 36. With such an arrangement, the second shaft 33 is inserted into the support shaft portion 36B. In this state, the driving gear 36 is rotatably supported by the second shaft 33. Furthermore, the guide tabs 31C of the base plate are each arranged within the guide groove 36A of the driving gear 36. In the rotation of the driving gear 36, the driving gear 36 is guided by the guide tabs 31C.

A coupling cylindrical portion 36C is integrally formed in the base end portion of the driving gear 36. The coupling cylindrical portion 36C is configured in an approximately cylindrical shape with the front-rear direction as its axial direction. The coupling cylindrical portion 36C is arranged such that it protrudes forward from the driving gear 36 and such that it is arranged coaxially with the second shaft 33 (support shaft portion 36B). A slit 36D having an opening that faces the front side is formed in the coupling cylindrical portion 36C. Furthermore, the slit 36D is configured such that it passes through in a radial direction of the coupling cylindrical portion 36C (specifically, in the upper-lower direction). With such an arrangement, the rear end portion of the attaching/detaching bar 20 is inserted into the coupling cylindrical portion 36C. Furthermore, the coupling pin 23 is inserted into the slit 36D. With this, the attaching/detaching bar 20 and the driving gear 36 are coupled such that they can be rotated as a single unit. Furthermore, a gear portion 36E is configured as multiple gear teeth in the edge portion (arc-shaped outer circumferential portion) of the driving gear 36. The gear portion 36E is formed along the circumferential direction of the driving gear 36.

[Regarding the Operating Mechanism 40]

The operating mechanism 40 is configured including an operating member 42, a support body 41 (which is broadly regarded as a "support member") configured to support the operating member 42, and a return spring 44.

The support body 41 is configured in an approximately track-shaped block structure with the upper-lower direction as its longitudinal direction as viewed from the front side. The support body 41 is arranged adjacent to the rear side of the lower-right portion of the base plate 31. A pair of left and right fixing tabs 41A are integrally formed in the support body 41. Each fixing tab 41A is arranged with the front-rear direction as its thickness direction. With such an arrangement, one fixing tab 41A is configured such that it protrudes rightward from the front end portion of the upper end portion of the support body 41. The other fixing tab 41A is configured such that it protrudes leftward from the front end portion of an intermediate portion of the support body 41 in the upper-lower direction. A fixing hole 41B is formed as a circular through hole in each fixing tab 41A. With such an arrangement, a screw is inserted from the rear side into the fixing hole 41B, and is screwed to the base plate 31, thereby fixing the support body 41 to the base plate 31.

A support hole 41C is formed in the upper portion of the support body 41 as a through hole that passes through in the front-rear direction. The support hole 41C is arranged coaxially with the second insertion hole 31B formed in the base plate 31. The support hole 41C is designed to have a diameter that is larger than that of the second insertion hole 31B. Furthermore, a support recess portion 41D is formed in the lower portion of the front face of the support body 41 such that it has an opening that faces the front side and the right side. The support recess portion 41D is configured such that it communicates with the support hole 41C. Furthermore, a holding groove 41E is formed in an intermediate portion in the upper-lower direction of the right-side portion of the support body 41 such that it has an opening that faces the front side. The holding groove 41E is configured such that it passes through in the left-right direction. With such an arrangement, the holding groove 41E is configured such that it communicates with the support recess portion 41D and the support hole 41C.

A limiting groove 41F (which is a component that is broadly regarded as a "groove portion") is formed in the lower portion of the rear face of the support body 41. The limiting groove 41F is configured such that it extends in the upper-lower direction. The limiting groove 41F is configured such that its upper end portion communicates with the support hole 41C. Furthermore, the limiting groove 41F is configured such that it passes through in the front-rear direction and such that it communicates with the support recess portion 41D. The limiting groove 41F is designed to have a groove width (size in the left-right direction) that is the same as the groove width (size in the upper-lower direction) of the holding groove 41E. Furthermore, an engagement groove 41G is formed in the upper end portion of the rear face of the support body 41 such that it has an opening that faces the rear side. The engagement groove 41G is configured such that it extends in the upper-lower direction and such that its lower end communicates with the support hole 41C.

The operating member 42 is configured in an approximately stepped shaft shape with the front-rear direction as its axial direction. Specifically, the operating member 42 is configured including a head portion 42A configured as a base end portion (rear end portion) of the operating member 42, a first operating shaft portion 42B configured such that it extends from the head portion 42A toward the front side (one side in the axial direction of the operating member 42), and a second operating member 42C configured such that it extends from the first operating shaft portion 42B toward the front side. With such an arrangement, the first operating member 42B is configured to have a diameter that is smaller than that of the head portion 42A. The second operating shaft portion 42C is configured to have a diameter that is smaller than that of the first operating shaft portion 42B.

With such an arrangement, the operating member 42 is inserted into the support hole 41C of the support body 41 from the rear side. Specifically, the second operating shaft portion 42C is rotatably inserted into the second insertion hole 31B of the base plate 31. Furthermore, the first operating shaft portion 42B is rotatably inserted into the support hole 41C of the support body 41. With this, the operating member 42 is supported by the support body 41 and the base plate 31 such that it can be rotated and relatively moved (slid) in the front-rear direction. With such an arrangement, in the non-operating state of the operating member 42 (initial state), the operating member 42 is set to the initial position (position indicated in FIGS. 6A and 7A). When the operating member 42 is set to the initial position, the head portion 42A and the rear portion of the first operating shaft portion 42B are set such that they protrude rearward from the support body 41. Furthermore, the operating member 42 is configured to allow the user to operate it such that it is pressed from the initial position toward the front side. Upon pressing the operating member 42, the operating member 42 is configured such that it is set to the first operating position (position shown in FIGS. 6B and 8A). Furthermore, when the operating member 42 is set to the first operating position, the operating member 42 is configured to allow the user to rotate it. Specifically, the operating member 42 is configured to allow it to be rotated from the first operating position toward one direction side in the rotational direction (the direction side indicated by the arrow D in FIGS. 5 and 8A) such that it is set to a second operating position (position shown in FIG. 8B).

The operating member 42 is configured such that its head portion 42A protrudes rearward from the cover 11 of the bed portion 10C, so as to allow the user to operate it as an exposed external component of the sewing machine 10 (see FIG. 1). Furthermore, a groove 42D is formed in the rear face of the head portion 42A such that it has an opening that faces the rear side and such that it extends along the radial direction of the head portion 42A. When the operating member 42 is to be pressed or rotated in the operation, this arrangement allows the user to operate the operating member 42 using a tool in a state in which the tool is inserted into the groove 42D. Furthermore, an engagement groove 42E (see FIG. 3) is formed in the outer circumferential portion of the head portion 42A such that it has an opening that faces the front side.

Furthermore, a positioning pin 43 (see FIG. 3) is provided to the end portion of the first operating shaft portion 42B. The positioning pin 42 is configured such that it protrudes toward the outer side in the radial direction of the first operating shaft portion 42B. The positioning pin 43 is designed to have a diameter that is slightly smaller than the groove widths of the limiting groove 41F and the holding groove 41E of the support body 41. With such an arrangement, when the operating member 42 is set to the initial position, the positioning pin 43 is set such that it is arranged within the limiting groove 41F of the support body 41. With this, when the operating member 42 is set to the initial position, the positioning pin 43 is engaged with the limiting groove 41F along the circumferential direction of the operating member 42, thereby preventing the rotational operation of the operating member 42.

Upon pressing the operating member 42 such that it is set to the first operating position, the positioning pin 43 is set such that it is arranged within the support recess portion 41D of the support body 41, thereby allowing the user to rotate the operating member 42 such that it is set to the second operating position. That is to say, the operating member 42 is configured to allow the user to rotate it after it is pressed in the operation. Furthermore, the operating member 42 is designed such that, when the operating member 42 is operated such that it is set to the second operating position, the positioning pin 43 is arranged in front of the holding groove 41E of the support body 41. With this arrangement, upon displacing the operating member 42 at the second operating position rearward such that it is inserted into the holding groove 41E, the positioning pin 43 (i.e., the operating member 42) is held by the holding body 41 (this position will be referred to as a "holding position" provided by the operating member 42).

A return spring 44 is configured as a compression torsion spring. The return spring 44 is mounted on the first operating shaft portion 42B of the operating member 42 such that it is positioned between the head portion 42A of the operating member 42 and the support body 41.

Furthermore, one end portion of the return spring 44 is engaged with the engagement groove 41G of the support body 41. The other end portion of the return spring 44 is engaged with the engagement groove 42E of the operating member 42. With such an arrangement, the return spring 44 forces the operating member 42 at the initial position toward the rear side and toward the other side in the rotational direction. With this, the operating member 42 is held at the initial position by the force applied by the return spring 44. Furthermore, when the operation for the operating member 42 is released at the second position, the operating member 42 is returned to the initial position via the first operating position by the force applied by the return spring 44.

Furthermore, the operating member 42 includes a manual gear 45 configured to transmit the operational force applied by the operating member 42 to the transmission mechanism 50 described later. The manual gear 45 is configured in an approximately fan-shaped plate shape with the front rear direction as its thickness direction. In a front view, the manual gear 45 is configured in an approximately quadrant shape arranged such that it protrudes diagonally rightward and upward. A fixing portion 45A is formed in the base end portion of the manual gear 45 such that it protrudes rearward. A fixing hole portion 45B is formed in the fixing portion 45A as a through hole such that it passes through in the front-rear direction. With such an arrangement, the front end portion of the operating member 42 is fitted within the fixing hole portion 45B. The manual gear 45 is fixed to the operating member 42 by a fixing screw SC such that it cannot be relatively moved. Furthermore, when the operating member 42 is set to the initial position, the fixing portion 45A is in contact with the front face of the base plate 31. In this state, the manual gear 45 restricts the movement of the operating member 42 at the initial position toward the rear side.

A pressing rib 45C (which is a component that is broadly regarded as a "pressing portion") is formed as the front-side edge portion formed in the edge portion (arc-shaped portion) of the manual gear 45. The pressing rib 45C is configured such that it extends along the circumferential direction of the manual gear 45 with the radial direction of the manual gear 45 as its thickness direction.

Furthermore, a gear portion 45D configured as multiple gear teeth is formed in the edge portion of the manual gear 45. The gear portion 45D is formed in the manual gear 45 along its circumferential direction except for one end portion in the rotational direction in the edge portion of the manual gear 45 (the side indicated by the arrow D in FIG. 5). That is to say, the edge portion of the manual gear 45 is configured of the gear portion 45D in which gear teeth are formed and an incomplete gear portion 45E having no gear teeth.

[Regarding the Transmission Mechanism 50]

The transmission mechanism 50 is configured including a large-diameter gear 51 configured as a "first gear", a small-diameter gear 52 configured as a "second gear", and a clutch mechanism 53 configured to couple the large-diameter gear 51 and the small-diameter gear 52.

The large-diameter gear 51 is configured in a disk shape with the front-rear direction as its thickness direction. The large-diameter gear 51 is configured to have a diameter that is larger than that of the motor gear 35. A support hole 51A is formed in the shaft core portion of the large-diameter gear 51 as a circular through hole that passes through in the front-rear direction. With such an arrangement, the first shaft 32 of the base plate 31 is inserted into the support hole 51A. In this state, the large-diameter gear 51 is rotatably supported by the first shaft 32.

A gear portion 51B configured as multiple gear teeth is formed in the outer circumferential portion of the large-diameter gear 51. The large-diameter gear 51 is arranged such that the gear portion 51B meshes with the gear portion 35A of the motor gear 35. Furthermore, a cylindrical protrusion portion 51C is formed on the front face of the large-diameter gear 51. The protrusion portion 51C is arranged coaxially with the large-diameter gear 51. With such an arrangement, the gear portion 36E of the driving gear 36 described above is arranged adjacent to the front side of the protrusion portion 51C. Furthermore, a fitting recess portion 51D configured as a "fitting portion" that forms the clutch mechanism 53 described later is formed in the protrusion portion 51C such that it is positioned in a shaft core portion of the large-diameter gear 51. The fitting recess portion 51D is configured as a recess having an opening that faces the front side, and is configured in an approximately D-shaped structure in a plan view such that it communicates with the support hole 51A.

The small-diameter gear 52 is configured in an approximately cylindrical shape with the front-rear direction as its axial direction. The small-diameter gear is configured to have a diameter that is smaller than that of the large-diameter gear 51. A support hole 52A is formed as a circular through hole in the shaft core portion of the small-diameter gear 52 such that it passes through in the front-rear direction. With such an arrangement, the first shaft 32 of the base plate 31 is inserted into the support hole 52A. In this state, the small-diameter gear 52 is rotatably supported by the first shaft 32 such that it is positioned on the front side of the large-diameter gear 51 and below the driving gear 36.

A fitting protrusion 52B configured as a "fitting target portion" that forms the clutch mechanism 53 described later is formed on the rear face of the small-diameter gear 52 such that it is positioned at the shaft center portion thereof. The fitting protrusion 52B is configured in an approximately D-shaped structure that is similar to the fitting recess portion 51D as viewed from the rear side such that it protrudes rearward from the small-diameter gear 52. With such an arrangement, the fitting protrusion 52B is inserted (fitted) into the fitting recess portion 51D so as to couple the small-diameter gear 52 and the large-diameter gear 51 such that they can be rotated as a single unit.

A gear portion 52C configured as multiple gear teeth is formed in the outer circumferential portion of the small-diameter gear 52. The small-diameter gear 52 is arranged such that the gear portion 52C meshes with the gear portion 36E of the driving gear 36. Furthermore, the manual gear 45 described above is arranged below the small-diameter gear 52. With such an arrangement, when the operating member 42 is set to the initial position, the manual gear 45 is not coupled to the small-diameter gear 52. When the operating member 42 is operated, the manual gear 45 is coupled to the small-diameter gear 52. Specifically, when the operating member 42 is set to the initial position or the first operating position, the manual gear 45 is set such that the incomplete gear portion 45E thereof faces the gear portion 52C of the small-diameter gear 52 in the radial direction of the small-diameter gear 52 and the manual gear 45. In this state, the manual gear 45 does not mesh with the small-diameter gear 52 (see FIG. 9A). In contrast, when the operating member 42 is rotated with a predetermined angle from the first operating position to the second operating position so as to rotate the manual gear 45 in one rotational direction around the axis of the operating member (the direction indicated by the arrow D in FIG. 8A), the manual gear 45 is set such that the gear portion 45D thereof meshes with the gear portion 52C of the small-diameter gear 52 (see FIG. 9B). With this arrangement, the manual gear 45 is coupled to the driving gear 36 via the small-diameter gear 52.

Furthermore, a flange 52D is formed in the outer circumferential portion of the front end portion of the small-diameter gear such that it protrudes outward in the radial direction. The flange 52D is formed over the entire outer circumferential portion of the small-diameter gear 52, and is arranged on the front side of the gear portion 36E of the driving gear 36. The flange 52D is arranged adjacent to the front side of the pressing rib 45C of the manual gear 45 described above. With this, upon operating the operating member 42 such that it is pressed from the initial position to the first operating position, the small-diameter gear 52 (flange 52D thereof) is pressed frontward, thereby operating the clutch mechanism 53 described later.

The clutch mechanism 53 is configured including the aforementioned fitting recess portion 51D of the large-diameter gear 51, the aforementioned fitting protrusion 52B of the small-diameter gear 52, and a clutch spring 54. The clutch spring 54 is configured as a compression spring. With such an arrangement, the clutch spring 54 is mounted on the front end portion of the first shaft 32 such that it is positioned on the front side of the small-diameter gear 52. Furthermore, the front end portion of the clutch spring 54 is engaged with an E-ring ER attached to the first shaft 32. The rear end portion of the clutch spring 54 is engaged with the small-diameter gear 52. In this state, the clutch spring 54 applies a force to the small-diameter gear 52 toward the rear side (large-diameter gear 51 side). With this arrangement, a fitting state is maintained between the fitting protrusion 52B of the small-diameter gear 52 and the fitting recess portion 51D of the large-diameter gear 51 (this state will be referred to as a "non-operating state" of the clutch mechanism 53 hereafter).

With such an arrangement, as described above, upon operating the operating member 42 such that it is pressed, the pressing rib 45C of the manual gear 45 presses the small-diameter gear 52 (the flange 52D thereof) so as to operate the clutch mechanism 53. Specifically, with such an arrangement, the small-diameter gear 52 is moved frontward against the force applied by the clutch spring 54 so as to switch the clutch mechanism 53 from the non-operating state to the operating state (state shown in FIG. 6B). With such an arrangement, when the clutch mechanism 53 is set to the operating state, the fitting state between the fitting recess portion 51D and the fitting protrusion 52B is released, thereby allowing the small-diameter gear 52 to be relatively rotated with respect to the large-diameter gear 51. It should be noted that, when the clutch mechanism 53 is set to the operating state, the meshing state in which the small-diameter gear 52 meshes with the driving gear 36 is maintained.

[Regarding the Control Unit 60]

As shown in FIG. 3, the control unit 60 is electrically connected to the aforementioned needle plate motor 34 and a control unit 62 (see FIG. 1) provided to the pillar portion 10A of the sewing machine 10. As shown in FIG. 1, the operating unit 62 is configured including a touch panel such that it is exposed as an external component that allows the user to perform an operation. The control unit 60 is configured to control the operation of the needle plate motor 34 according to an operation signal received from the operating unit 62.

[Operation and Effects]

Next, description will be made regarding the operation and the effects of the first embodiment with reference to a case in which the fixed state of the needle plate 15 is released by the driving operation of the needle plate motor 34 and a case in which the fixed state of the needle plate 15 is released by the operation of the operating member 42.

[Regarding a Case in which the Fixed State of the Needle Plate 15 is Released by the Driving Operation of the Needle Plate Motor 34]

Figure 4A:
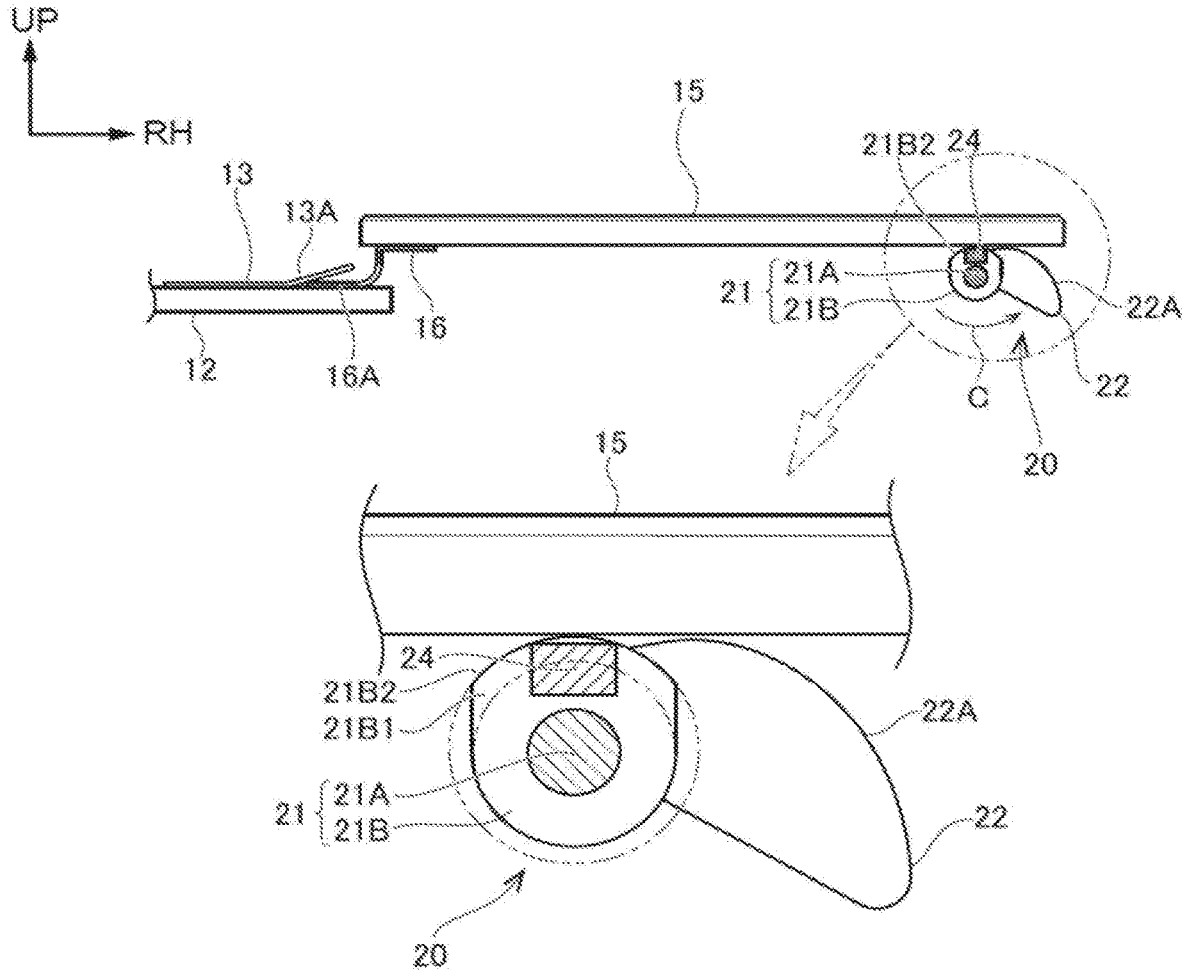
FIG. 4A is a front view showing the fixed state of the needle plate shown in FIG. 2 as viewed from the front side.

As shown in FIG. 4A, the tip portions of the engagement tabs 16A of the needle plate 15 are inserted into a gap between the presser tab 13A of the first presser member 13 and the fixing plate 12 and a gap between the second presser tab 14A of the second presser member 14 and the fixing plate 12 from the right side so as to engage the engagement tabs 16A with the presser tabs 13A and 14A. In this state, the attaching/detaching bar 20 of the needle plate attaching/detaching mechanism 18 is set to the fixed position. In this state, the needle plate 15 is drawn downward by the magnetic force of the magnets 24 provided to the attaching/detaching bar 20.

Figure 5:
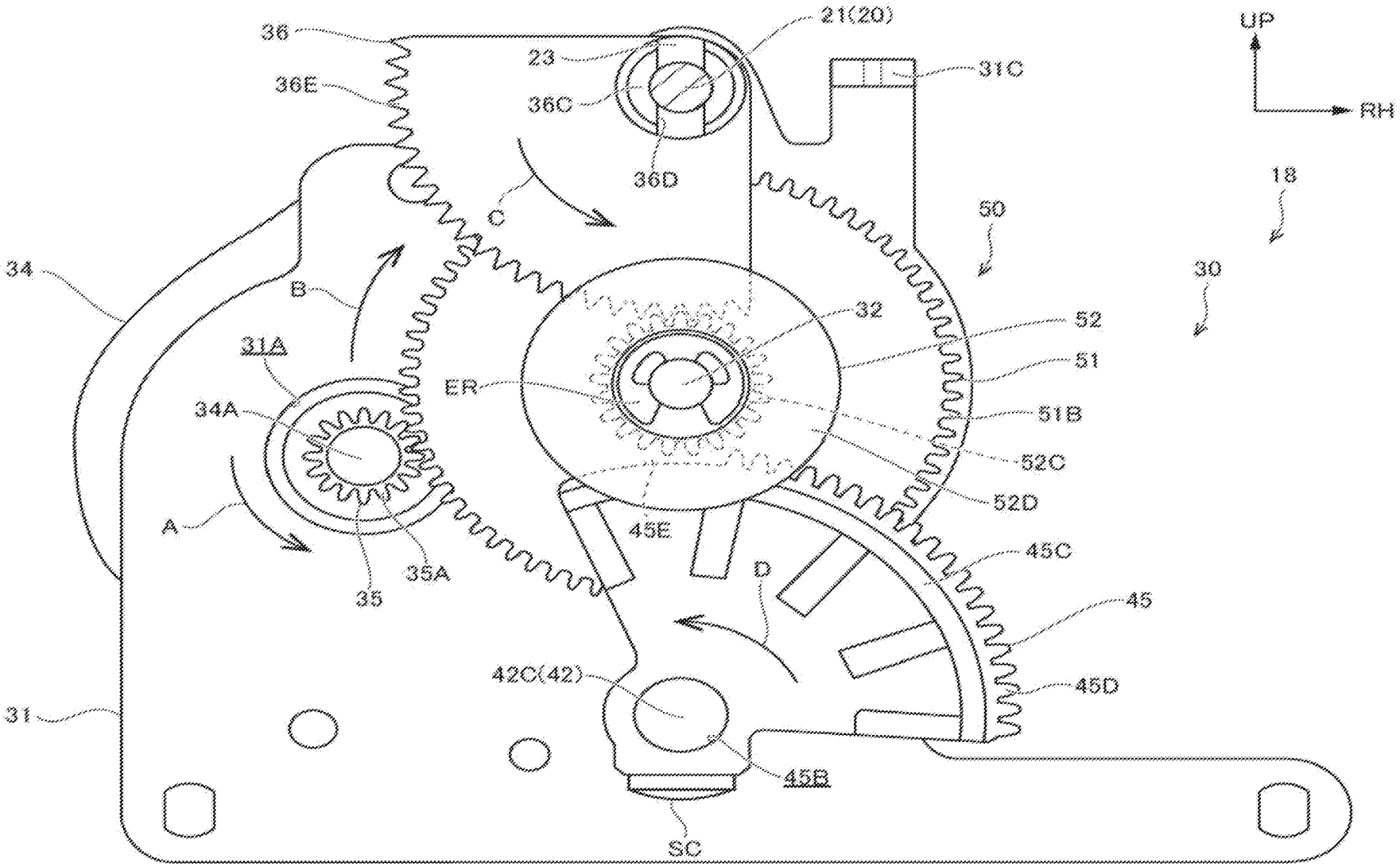
FIG. 5 is a front view showing a driving mechanism shown in FIG. 2.
Figure 6B:
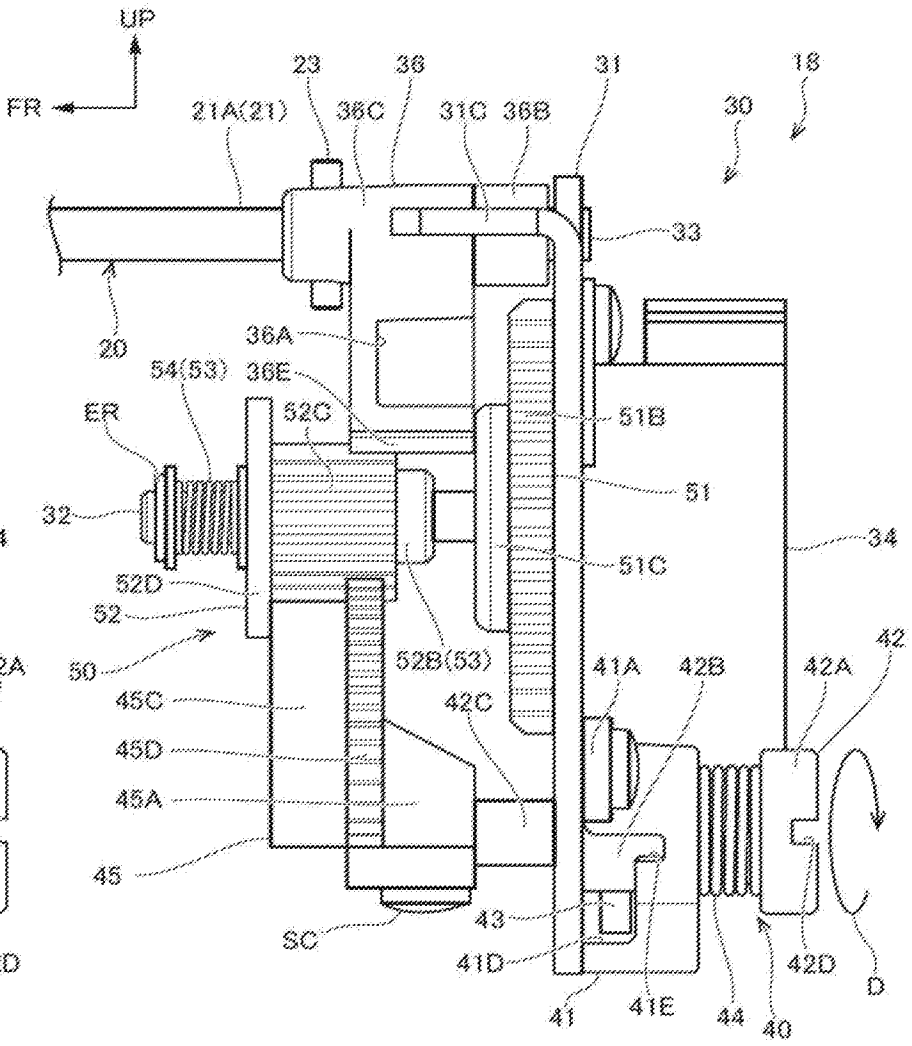
FIG. 6B is a side view showing a state in which an operating member shown in FIG. 6A is operated such that it is pressed toward a first operating position.
Figure 6A:
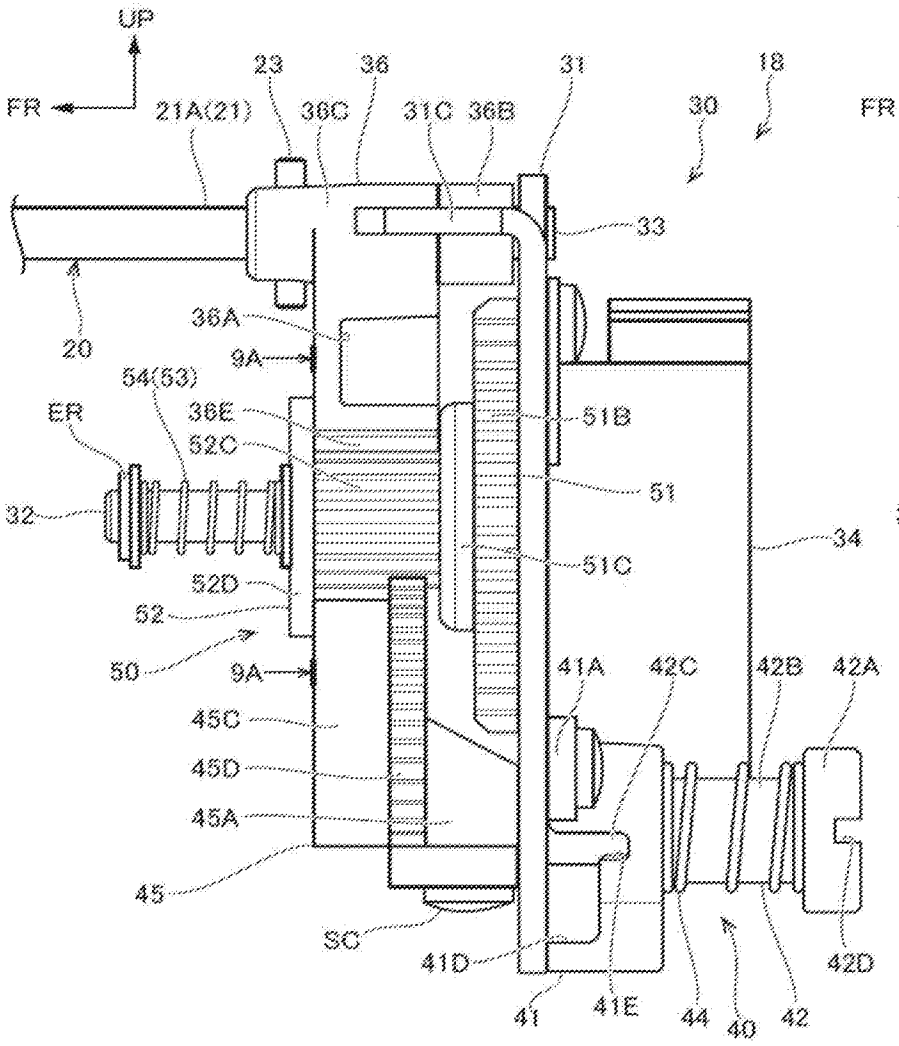
FIG. 6A is a side view showing the driving mechanism shown in FIG. 5 as viewed from the right side.
Figure 7B:
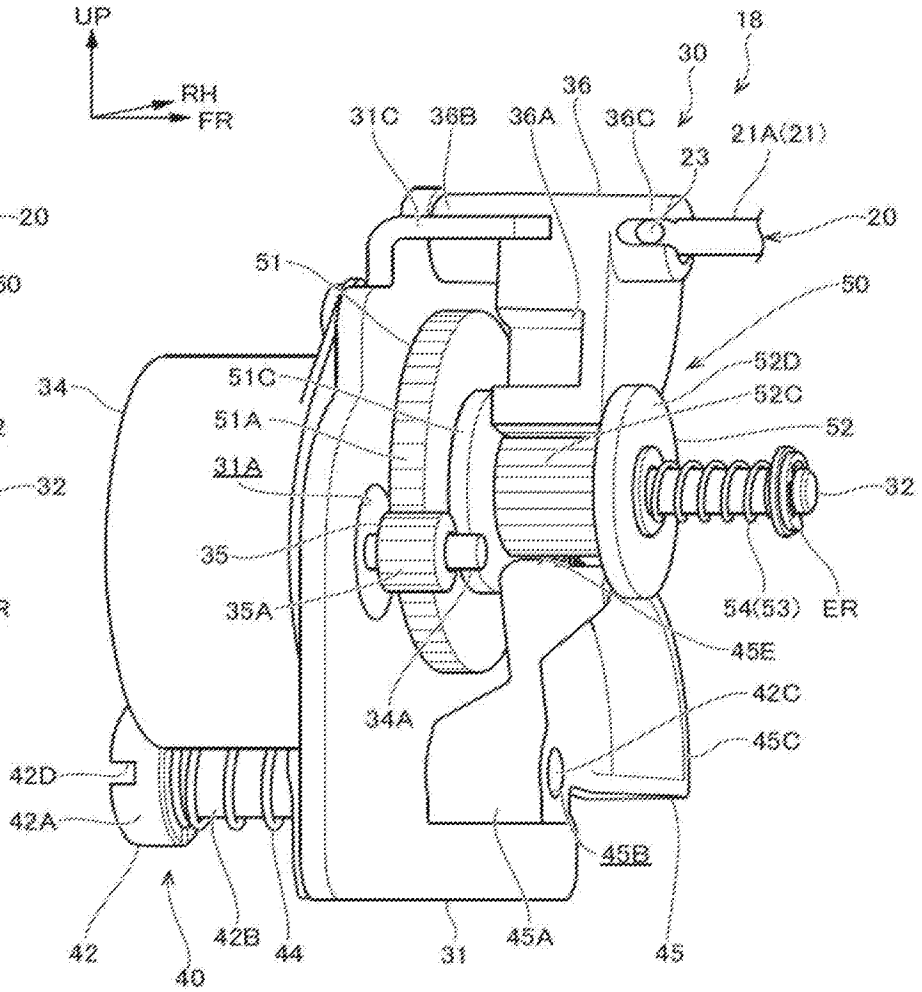
FIG. 7B is a perspective view showing an operating state of the needle plate attaching/detaching mechanism provided by the driving operation of a needle plate motor shown in FIG. 7A as viewed diagonally from the left side and the front side.
Figure 7A:
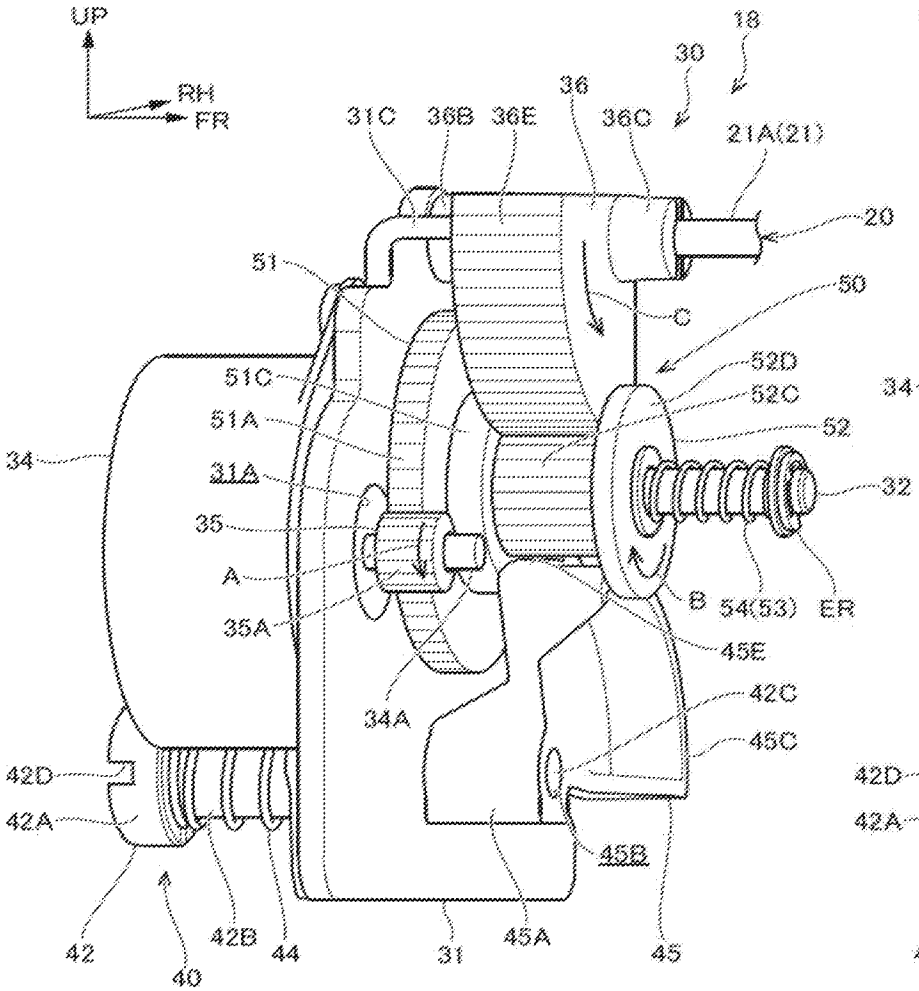
FIG. 7A is a perspective view showing the needle plate attaching/detaching mechanism shown in FIG. 2 as viewed diagonally from the left side and the front side.
Figure 8B:
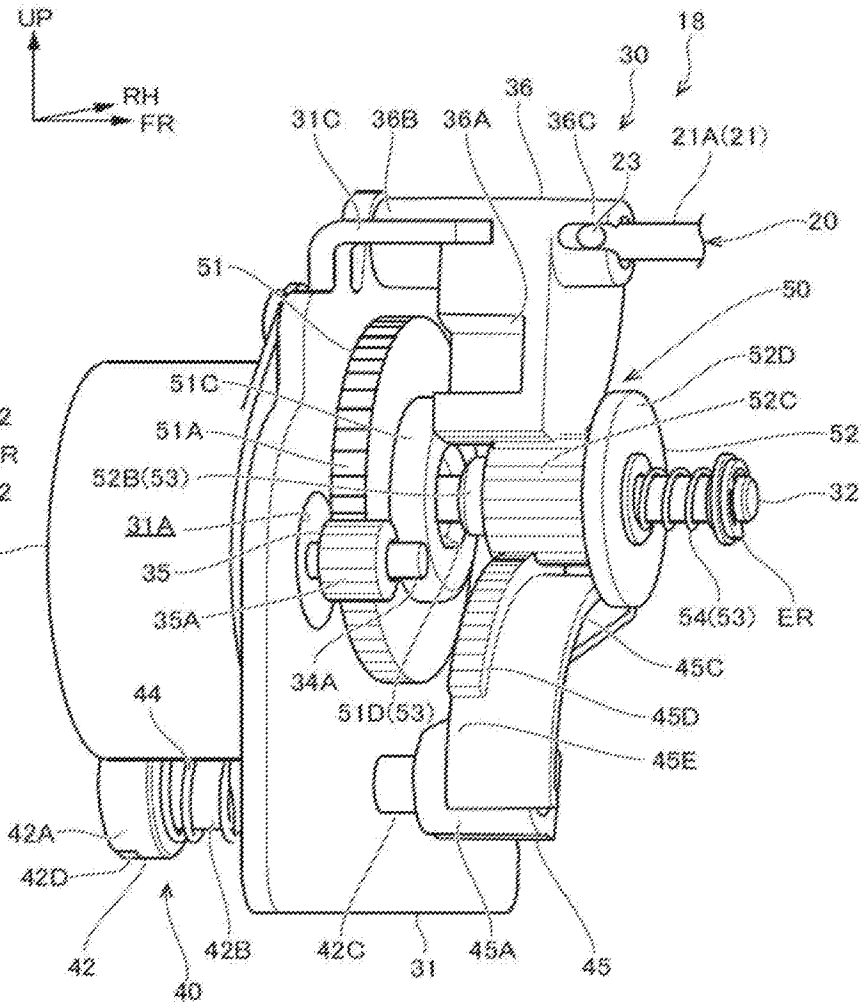
FIG. 8B is a perspective view showing the operating state of the needle plate attaching/detaching mechanism provided by the operation for the operating member shown in FIG. 8A as viewed diagonally from the left side and the front side.

Furthermore, as shown in FIGS. 5, 6A, and 7A, when the needle plate 15 is set to the fixed state, the clutch mechanism 53 of the needle plate attaching/detaching mechanism 18 is set to the non-operating state. Accordingly, in this state, the motor gear 35 meshes with the large-diameter gear 51, and the large-diameter gear 51 and the small-diameter gear 52 are coupled such that they can be rotated as a single unit. Furthermore, the small-diameter gear 52 meshes with the driving gear 36. That is to say, the motor gear 35 and the driving gear 36 are coupled by the transmission mechanism 50. In this state, the transmission mechanism 50 is set to a transmission state in which the driving force of the needle plate motor 34 is transmitted to the driving gear 36. Furthermore, when the transmission mechanism 50 is set to the transmission state, the operating member 42 is set to the initial position. In this state, the manual gear 45 does not mesh with the small-diameter gear 52. In this state, the manual gear 45 and the driving gear 36 are not coupled, thereby disconnecting the driving transmission path from the operating member 42 to the driving gear 36.

In this state, when the user operates the operating unit 62 so as to release the fixed state of the needle plate 15, the operating unit 62 outputs an operation signal to the control unit 60. The control unit 60 drives the needle plate motor 34. Specifically, the motor gear 35 is rotated in one rotational direction (the direction indicated by the arrow A in FIGS. 5 and 7A) around the axis of the output shaft 34A. This rotates the large-diameter gear 51 together with the small-diameter gear 52 in one rotational direction (the direction indicated by the arrow B in FIGS. 5 and 7A) around the axis of the first shaft 32. When the small-diameter gear 52 is rotated, the driving gear 36 is rotated in one rotational direction (the direction indicated by the arrow C in FIGS. 5 and 7A) around the axis of the second shaft 33. With this, the attaching/detaching bar 20 (rotational shaft 21) coupled to the driving gear 36 is rotated from the fixed position toward one side in the rotational direction (non-fixed position side). Subsequently, when the attaching/detaching bar 20 reaches the non-fixed position, the driving operation of the needle plate motor 34 is stopped (see FIG. 7B).

Figure 4B:
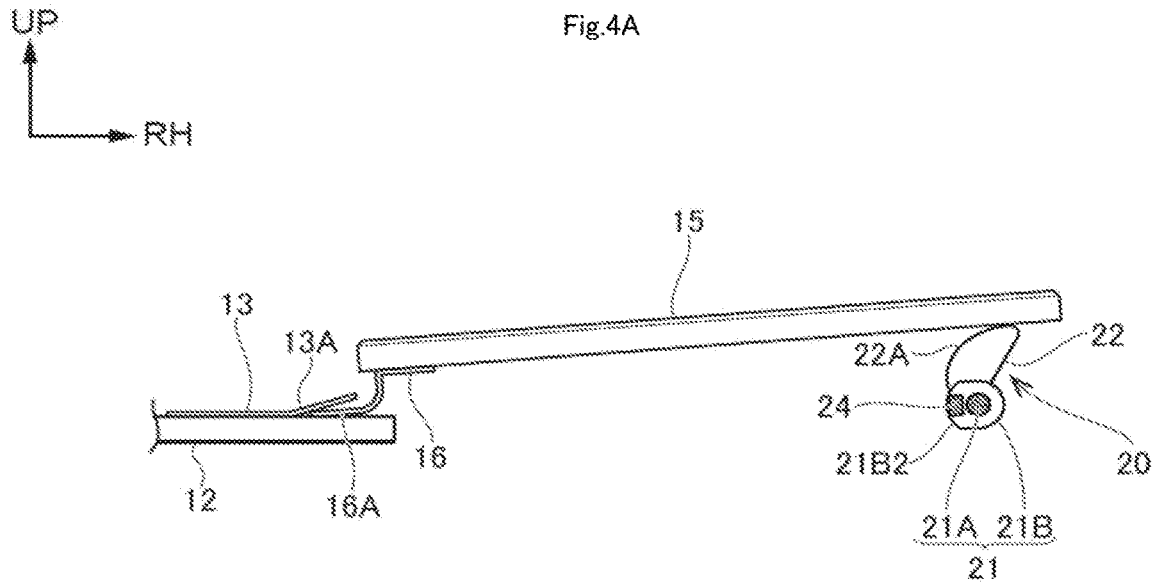
FIG. 4B is a front view showing a state in which the fixed state of the needle plate is released by a cam of an attaching/detaching bar shown in FIG. 4A.

When the attaching/detaching bar 20 is rotated from the fixed position toward one side in the rotational direction, the magnets 24 provided to the attaching/detaching bar 20 are relatively rotated (moved) leftward and downward with respect to the needle plate 15, thereby reducing the magnetic force applied by the magnets 24 to the needle plate 15. This releases the fixed state of the needle plate 15 provided by the magnets 24. Furthermore, in this stage, the cam 22 of the attaching/detaching bar 20 is displaced upward. In this state, the needle plate 15 is raised upward by the cam face 22A of the cam 22. Subsequently, after the attaching/detaching bar 20 is set to the non-fixed position, as shown in FIG. 4B, the needle plate 15 is displaced upward from the attaching/detaching bar 20 so as to provide a gap between them, thereby releasing the fixed state of the needle plate 15. This arrangement allows the needle plate 15 to be detached from the bed portion 10C.

Subsequently, after a predetermined period of time elapses after the attaching/detaching bar 20 is rotated to the non-fixed position, the control unit 60 instructs the needle plate motor 34 to perform a driving operation so as to rotate its output shaft 34A toward the other side in the rotational direction. This rotates the large-diameter gear 51, the small-diameter gear 52, and the driving gear 36 toward the other side in the rotational direction. In this operation, the attaching/detaching bar 20 is rotated from the non-fixed position to the fixed position side. Subsequently, when the attaching/detaching bar 20 reaches the fixed position, the driving operation of the needle plate motor 34 is stopped. With this, the needle plate attaching/detaching mechanism 18 is returned to a state in which the needle plate 15 can be mounted on the bed portion 10C.

[Regarding a Case in which the Fixed State of the Needle Plate 15 is Released by the Operation of the Operating Member 42]

As shown in FIGS. 5, 6A, and 7A, when the needle plate 15 is set to the fixed state, as in the operation described above, the operating member 42 of the operating mechanism 40 is set to the initial position. In this state, the clutch mechanism 53 provided to the needle plate attaching/detaching mechanism 18 is set to the non-operating state. That is to say, the transmission mechanism 50 is set to the transmission state.

With such an arrangement, when the fixed state of the needle plate 15 is to be released by the operation of the operating member 42, the user operates the operating member 42 at the initial position such that it is pressed toward the front side. In this operation, as shown in FIG. 6B, the operating member 42 is moved frontward against the force applied by the return spring 44, and is set to the first operating position. In this stage, the manual gear 45 of the operating member 42 moves frontward while it presses the flange 52D of the small-diameter gear 52 frontward. In this operation, the small-diameter gear 52 is moved frontward against the force applied by the clutch spring 54, thereby operating the clutch mechanism 53. That is to say, the fitting protrusion 52B of the small-diameter gear 52 is relatively moved frontward with respect to the fitting recess portion 51D of the large-diameter gear 51.

Subsequently, after the clutch mechanism 53 transits from the non-operating state to the operating state, the fitting protrusion 52B is detached from the fitting recess portion 51D, thereby releasing the coupling state between the small-diameter gear 52 and the large-diameter gear 51. With this, the transmission mechanism 50 releases the coupling state between the motor gear 35 and the driving gear 36. That is to say, the transmission mechanism 50 is switched to a disconnection state in which the driving transmission from the needle plate motor 34 to the driving gear 36 is disconnected.

Figure 8A:
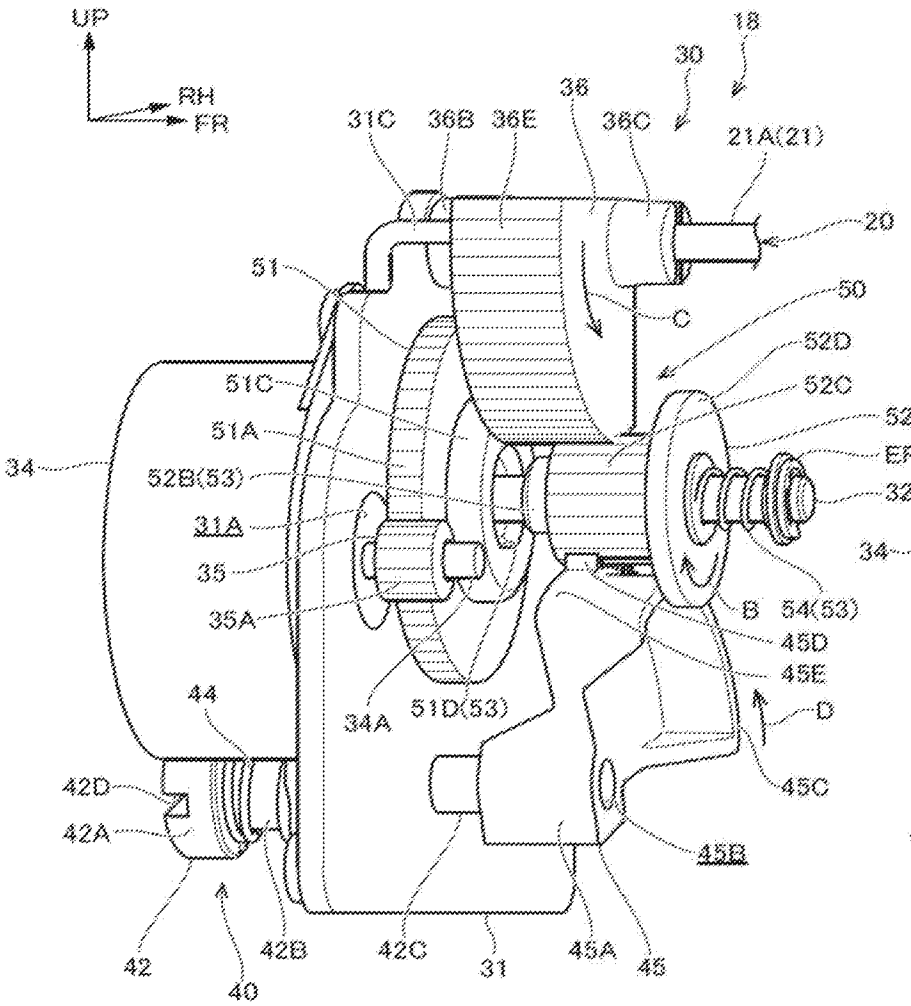
FIG. 8A is a perspective view showing the needle plate attaching/detaching mechanism shown in FIG. 6B as viewed diagonally from the left side and the front side when the rotational operation for the operating member is started.
Figure 9B:
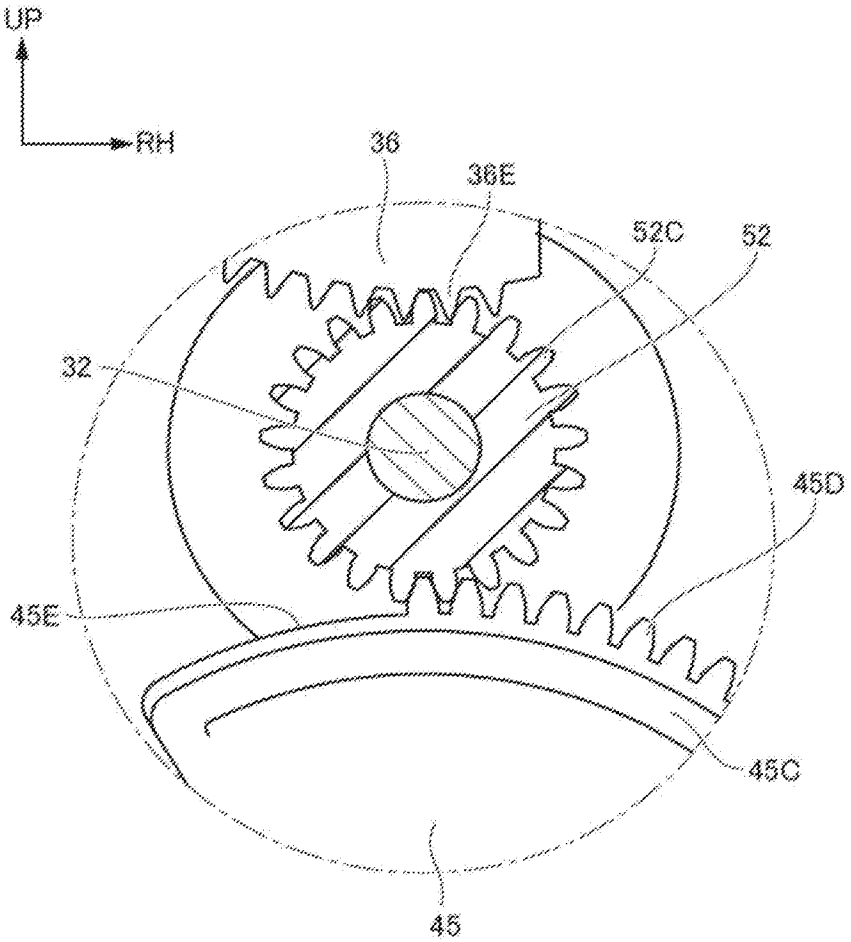
FIG. 9B is an enlarged cross-sectional diagram showing the position relation between the small-diameter gear and the manual gear in the state shown in FIG. 8A as viewed from the front side.
Figure 9A:
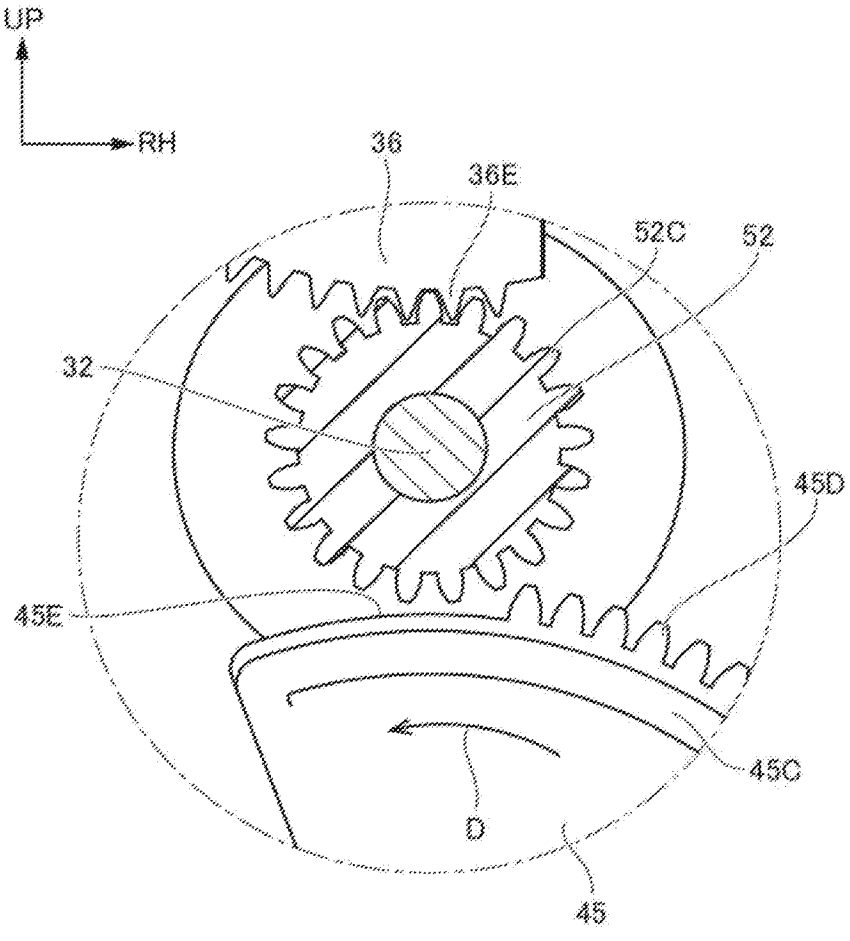
FIG. 9A is an enlarged cross-sectional diagram (cross-sectional view taken along line 9A-9A in FIG. 6A) showing the position relation between a small-diameter gear and a manual gear shown in FIG. 6A as viewed from the front side.

In this state, upon operating the operating member 42 such that it is rotated with a predetermined angle toward the second operating position side, the manual gear 45 is rotated in one rotational direction (the direction indicated by the arrow D in FIG. 9A) around the axis of the operating member 42. With this, as shown in FIGS. 8A and 9B, the gear portion 45D of the manual gear 45 meshes with the gear portion 52C of the small-diameter gear 52. Accordingly, the operating member 42 (manual gear 45) and the driving gear 36 are coupled by the small-diameter gear 52.

Subsequently, upon further rotating the operating member 42 toward the second operating position side, the small-diameter gear 52 that meshes with the manual gear 45 is rotated in one rotational direction (the direction indicated by the arrow B in FIG. 8A) around the axis of the first shaft 32. In addition, the driving gear 36 that meshes with the small-diameter gear 52 is rotated in one rotational direction (the direction indicated by the arrow C in FIG. 8A) around the axis of the second shaft 33. As a result, the attaching/detaching bar 20 (rotational shaft 21) coupled to the driving gear 36 is rotated from the fixed position to the non-fixed position side. Subsequently, when the attaching/detaching bar 20 is rotated such that it reaches the non-fixed position, the release operation of the operating member 42 for the needle plate 15 ends (see FIG. 8B).

Furthermore, when the operating member 42 is set to the second operating position, the positioning pin 43 provided to the operating member 42 is set such that it is positioned on the front side of the holding groove 41E of the support body 41. Accordingly, upon displacing the operating member rearward in a state in which the rotation of the operating member 42 is restricted, the positioning pin 43 is inserted into the holding groove 41E. With this, both the manual gear 45 and the operating member 42 are held at the holding positions while maintaining the meshing state between the manual gear 45 and the small-diameter gear 52. This maintains the state in which the attaching/detaching bar 20 is set to the non-fixed position. Accordingly, this arrangement allows the needle plate 15 to be detached from the bed portion 10C in a state in which the needle plate 15 is raised upward by the cam 22 of the attaching/detaching bar 20. It should be noted that, in this stage, the pressing rib 45C of the manual gear 45 is displaced rearward away from the flange 52 of the small-diameter gear 52. In this state, the clutch spring 54 applies a force to the small-diameter gear 52 so as to displace the small-diameter gear 52 toward the rear side. However, the fitting protrusion 52B of the small-diameter gear 52 is relatively rotated with respect to the fitting recess portion 51D of the large-diameter gear 51. That is to say, the fitting protrusion 52B is rotated away from a position at which it can be fitted within the fitting recess portion 51D. Accordingly, although such a force is applied so as to displace the small-diameter gear 52 rearward, the fitting protrusion 52B is not fitted within the fitting recess portion 51D. This maintains the state in which the small-diameter gear 52 is disconnected from the large-diameter gear 51.

With such an arrangement, when the attaching/detaching bar 20 is to be rotated from the non-fixed position to the fixed position, the user operates the operating member 42 at the holding position such that it is pressed toward the front side and such that it is set to the second operating position. In this state, upon releasing the operation for the operating member 42, the operating member 42 is rotated from the second operating position to the first operating position by the force applied by the return spring 44. In this operation, the positioning pin 43 is rotated while it is slid along the opening portion of the support recess portion 41D of the support body 41. With this, the manual gear 45 is rotated toward the other side in the rotational direction around the axis of the operating member 42. This rotates the small-diameter gear 52 and the driving gear 36 toward the other side in the rotational direction. Accordingly, the attaching/detaching bar 20 is rotated toward the other side in the rotational direction from the non-fixed state such that it is returned to the fixed position. Furthermore, when the operating member 42 is set to the first operating position, the meshing state between the manual gear 45 and the small-diameter gear 52 is released. Furthermore, in this state, the fitting protrusion 52B of the small-diameter gear 52 is returned to a position at which it can be fitted within the fitting recess portion 51D of the large-diameter gear 51.

When the operating member 42 is set to the first operating position, the operating member 42 is displaced rearward together with the manual gear 45 by the force applied by the return spring 44. As a result, the fixing portion 45A of the manual gear 45 comes in contact with the front face of the base plate 31. With this, the operating member 42 is returned to the initial position. Furthermore, in this stage, the pressing rib 45C of the manual gear 45 is displaced rearward with respect to the flange 52D. Accordingly, the small-diameter gear 52 is moved rearward by the force applied by the clutch spring 54. As a result, the fitting protrusion 52B of the small-diameter gear 52 is fitted within the fitting recess portion 51D of the large-diameter gear 51. With this, the small-diameter gear 52 and the large-diameter gear 51 are coupled again, thereby switching the clutch mechanism 53 to the non-operating state. Accordingly, the needle plate attaching/detaching mechanism 18 is returned to a state that allows the needle plate 15 to be mounted on the bed portion 10C.

As described above, the needle plate attaching/detaching mechanism 18 according to the present embodiment includes the transmission mechanism 50. The transmission mechanism 50 is configured to be switchable between the transmission state in which the driving force is transmitted from the needle plate motor 34 to the driving gear 36 and the disconnection state in which the transmission of the driving force is disconnected. Furthermore, the needle plate attaching/detaching mechanism 18 includes the operating member 42. The operating member includes the manual gear 45 configured to transmit a manual operating force to the driving gear 36.

With such an arrangement, when the operating member 42 is set to the non-operating state, the transmission mechanism 50 is set to the transmission state, and the manual gear 45 is disconnected from the driving gear 36. Accordingly, when the needle plate motor 34 is driven, the transmission mechanism 50 transmits the driving force of the needle plate motor 34 to the driving gear 36. This allows the attaching/detaching bar 20 to be rotated and to be switched from the fixed position to the non-fixed position. This allows the fixed state of the needle plate 15 to be automatically released. Accordingly, such an arrangement provides improved convenience for the user.

Furthermore, upon operating the operating member 42 such that it is pressed, the operating member 42 (the manual gear 45 thereof) sets the transmission mechanism 50 to the disconnection state. In the disconnection state, the driving force of the needle plate motor 34 is not transmitted to the driving gear 36. Furthermore, upon operating the operating member 42 such that it is rotated, the manual gear 45 provided to the operating member 42 and the driving gear 36 are coupled via the small-diameter gear 52. With this, the operating force of the operating member 42 is transmitted to the driving gear via the manual gear 45 and the small-diameter gear 52, thereby allowing the attaching/detaching bar 20 to be rotated such that it transits from the fixed position to the non-fixed position. Accordingly, at the time of an emergency situation such as a malfunction of the needle plate motor 34, such an arrangement allows the user to operate the needle attaching/detaching mechanism 18 manually so as to release the fixed state of the needle plate 15. As described above, with the needle plate attaching/detaching mechanism 18 according to the preset embodiment, such an arrangement ensures safety in an emergency situation while providing improved convenience for the user.

Furthermore, as described above, in the non-operating state of the operating member 42, the manual gear 45 is not coupled to the driving gear 36. Accordingly, in the driving operation of the needle plate motor 34, such an arrangement is capable of preventing the operating member 42 exposed as an external component from rotating.

Furthermore, the transmission mechanism 50 is configured including the large-diameter gear 51 that meshes with the motor gear 35 provided to the needle plate motor 34, and the small-diameter gear 52 configured such that it can be rotated together with the large-diameter gear 51 as a single unit and arranged such that it meshes with the driving gear 36. Furthermore, the manual gear 45 provided to the operating member 42 includes the gear portion 45D and the incomplete gear portion 45E. When the operating member 42 is set to the initial position, the manual gear 45 and the small-diameter gear 52 are not coupled by the incomplete gear portion 45D. With this, when the operating member 42 is set to the initial position, such an arrangement requires only a simple configuration to disconnect the manual gear 45 provided to the operating member 42 from the driving gear 36. Furthermore, upon operating the operating member 42 at the first operating position such that it is rotated with a predetermined angle, such an arrangement allows the gear portion 45D of the manual gear 45 to mesh with the small-diameter gear 52 so as to couple the manual gear 45 and the driving gear 36. Accordingly, when the user operates the operating member 42, this arrangement allows the operating force of the operating member 42 to be transmitted to the driving gear 36 so as to rotate the driving gear 36 and the attaching/detaching bar 20.

Furthermore, in the transmission mechanism 50, the small-diameter gear 52 is coupled to the large-diameter gear 51 by the clutch mechanism 53 such that they can be rotated as a single unit. With such an arrangement, upon operating the operating member 42 at the initial position such that it is pressed, the clutch mechanism 53 is operated according to this operation so as to release the coupling state between the small-diameter gear 52 and the large-diameter gear 51. Accordingly, when the user operates the operating member 42 such that it is rotated, such an arrangement is capable of preventing the occurrence of damage in the gear portion 45D of the manual gear 45 and the gear portion 52C of the small-diameter gear 52.

That is to say, in a case in which the clutch mechanism 53 is omitted, the driving force of the needle plate motor is transmitted to the small-diameter gear 52 via the transmission mechanism 50 at all times. That is to say, the transmission state is maintained at all times. Accordingly, if the user operates the operating member 42 such that it is rotated in the rotational operation of the small-diameter gear 52 provided by the driving force of the needle plate motor 34, the gear portion 45D of the manual gear 45 collides with the gear portion 52C of the small-diameter gear 52 in the rotational operation. This has the potential to cause damage in the gear portion 45D of the manual gear 45 and the gear portion 52C of the small-diameter gear 52.

In contrast, with the present embodiment, as described above, the clutch mechanism 53 operates according to the pressing operation of the operating member 42, which releases the coupling state between the small-diameter gear and the large-diameter gear 51. Accordingly, this arrangement allows the user to rotate the operating member after the driving transmission from the needle plate motor 34 to the small-diameter gear 52 is disconnected. With this, when the user operates the operating member 42 such that it is rotated, such an arrangement allows the manual gear 45 to be set such that it meshes with the small-diameter gear 52 in a state in which the rotation of the small-diameter gear 52 is stopped. That is to say, even if the user operates the operating member 42 in the driving operation of the needle plate motor 34, such an arrangement is capable of setting the manual gear 45 such that it meshes with the small-diameter gear 52 after the rotation of the small-diameter gear 52 is stopped. Accordingly, such an arrangement is capable of preventing damage in the gear portion 45D of the manual gear 45 and the gear portion 52C of the small-diameter gear 52.

Furthermore, the clutch mechanism 53 is configured including the fitting recess portion 51D formed in the large-diameter gear 51 and the fitting protrusion 52B formed in the small-diameter gear 52. With such an arrangement, the fitting protrusion 52B is inserted into the fitting recess portion 51D such that the large-diameter gear 51 and the small-diameter gear 52 can be rotated as a single unit. With such an arrangement, when the user operates the operating member 42 such that it is pressed, the pressing rib 45C of the manual gear 45 presses the flange 52D of the small-diameter gear 52 so as to release the fitting state between the fitting recess portion 51D and the fitting protrusion 52B. This requires only a simple configuration to operate the clutch mechanism 53 according to the pressing operation of the operating member 42.

Furthermore, in a front view, the fitting recess portion 51D is configured in a D-shaped structure. The fitting protrusion 52B is also configured in a D-shaped structure that is similar to the fitting recess portion 51D as viewed from the rear side. Accordingly, the fitting protrusion 52B is fitted within the fitting recess portion 51D only when the large-diameter gear 51 and the small-diameter gear 52 are set to the rotational position before the operation of the clutch mechanism 53. In other words, in a state in which the relative rotational position relation between the large-diameter gear 51 and the small-diameter gear 52 is set to a predetermined relation, the fitting protrusion 52B is fitted within the fitting recess portion 51D, which couples the large-diameter gear 51 and the small-diameter gear 52. This arrangement is capable of preventing an abnormal operation in the needle plate attaching/detaching mechanism 18, for example.

That is to say, in a case in which the fitting protrusion 52B can be fitted within the fitting recess portion 51D at any one from among multiple positions along the rotational direction of the large-diameter gear 51 (small-diameter gear 52), when the large-diameter gear 51 and the small-diameter gear 52 are coupled by the clutch mechanism 53, such an arrangement has the potential to cause a change in the relative rotational position relation between the large-diameter gear 51 and the small-diameter gear 52. For example, if the needle plate motor 34 is driven so as to rotate the large-diameter gear 51 with respect to the small-diameter gear 52 in a manual operation in which the user operates the operating member 42 manually, such an arrangement has the potential to couple the small-diameter gear 52 to the large-diameter gear 51 thus rotated. In this case, there is a difference in the state of the needle plate motor 34 between after the coupling of the large-diameter gear 51 and the small-diameter gear 52 and before the coupling of the large-diameter gear 51 and the small-diameter gear 52. Accordingly, when the control unit instructs the needle plate motor 34 to perform the driving operation, such an arrangement has the potential to cause an abnormal operation of the needle plate attaching/detaching mechanism 18.

In contrast, with the present embodiment, as described above, the fitting protrusion 52B is fitted within the fitting recess portion 51D in a state in which the relative rotational position relation is maintained between the large-diameter gear 51 and the small-diameter gear 52. In this state, the large-diameter gear 51 and the small-diameter gear 52 are coupled. With this, when the needle plate motor 34 is driven in a manual operation in which the user operates the operating member 42 manually, such an arrangement is capable of returning the needle plate motor to the previous state to which it was set before the driving operation. This allows the large-diameter gear 51 and the small-diameter gear 52 to be coupled again in this state. As a result, such an arrangement is capable of preventing a change in the state of the needle plate motor 34 when the large-diameter gear 51 and the small-diameter gear 52 are coupled. This arrangement is capable of preventing an abnormal operation of the needle plate attaching/detaching mechanism 18, for example.

Furthermore, the operating member 42 is provided with the positioning pin 43. With such an arrangement, when the operating member 42 is set to the initial position, the positioning pin 43 is set such that it is arranged within the limiting groove 41F of the support body 41. In this state, the positioning pin 43 is engaged with the limiting groove 41F for limiting the rotational direction of the operating member 42. With this, when the operating member 42 is set to the initial position, such an arrangement is capable of preventing the rotational operation of the operating member 42. Upon pressing the operating member 42 such that is set to the first operating position, the positioning pin 43 is detached from the limiting groove 41F, thereby allowing the rotational operation of the operating member 42. Accordingly, such an arrangement is capable of preventing the user from performing an erroneous operation of the operating member 42.

Furthermore, the holding groove 41E is formed in the support body 41. With such an arrangement, after the operating member 42 is operated such that it is set to the second operating position, upon displacing the operating member 42 toward the front side so as to insert the positioning pin 43 into the holding groove 41E, such an arrangement is capable of holding the operating member 42 at the holding position. With this, by holding the operating member 42 at the holding position after the user operates the operating member 42 manually, such an arrangement is capable of maintaining a state in which the attaching/detaching bar 20 is set to the non-fixed position. As a result, in a state in which the needle plate 15 is lifted upward by the attaching/detaching bar 20 (the cam 22 thereof), such an arrangement allows the needle plate 15 to be detached from the bed portion 10C in a simple manner. Accordingly, such an arrangement provides improved convenience for the user.

It should be noted that description has been made in the present embodiment regarding an arrangement in which, upon rotating the attaching/detaching bar 20, the cam 22 lifts the needle plate 15 upward. However, the mechanism for lifting the needle plate 15 upward is not restricted to such an arrangement. For example, a bar-shaped release pin may be provided to the rotational shaft 21 such that it protrudes toward the outer side in a radial direction thereof. The rotational shaft 21 may be configured to lift the needle plate 15 upward by the tip portion of the bar-shaped release pin. Also, the needle plate 15 may be provided with a magnet. Furthermore, instead of the cam 22, the attaching/detaching bar 20 may be provided with a magnet that provides the same magnetic polarity as that provided by the needle plate 15. Such an arrangement may be configured to lift the needle plate 15 upward using the repulsion force generated by the magnets. It should be noted that, in order to provide a gap that allows the operator to insert his/her fingers into the gap, such a configuration is employed in which the needle plate 15 is lifted upward by the cam 22. That is to say, such a configuration is employed so as to facilitate the operation of detaching the needle plate 15. Accordingly, in a case in which such a gap is provided at another portion, or in a case in which a needle bar detaching mechanism or the like is provided as an additional component, the cam 22 may be omitted.

Description has been made in the present embodiment regarding an arrangement in which the needle plate 15 is fixed using the magnetic force applied by the magnets 24 provided to the attaching/detaching bar 20. However, such a mechanism for fixing the needle plate 15 is not restricted to such an arrangement. For example, the needle plate 15 may be provided with a striker having an approximate U-shaped bar structure having an opening that faces the upper side. Furthermore, the rotational shaft 21 of the attaching/detaching bar 20 may be provided with a hook that can be engaged with the striker in the upper-lower direction, so as to allow the needle plate 15 to be fixed. In this case, such an arrangement may preferably be configured such that, when the attaching/detaching bar 20 is rotated such that it is switched from the fixed position to the non-fixed position, the engagement state between the hook and the striker is released.

Description has been made in the present embodiment regarding an arrangement in which the driving mechanism 30 is coupled to the rear end portion of the attaching/detaching bar 20 (rotational shaft 21). Also, the driving mechanism 30 may be coupled to the front end portion of the attaching/detaching bar 20 (rotational shaft 21). In this case, the driving mechanism 30 may be arranged such that it is geometrically reversed in the front-rear direction such that the driving mechanism 30 is coupled to the front end portion of the mounting/detaching bar 20 (rotational shaft 21). With this arrangement, the head portion 42A of the operating member 42 is exposed as an external component on the front side of the cover 11 so as to allow the user to operate it manually. This arrangement provides further improve convenience for the operator.

Description has been made in the present embodiment regarding an arrangement in which the fitting recess portion 51D of the large-diameter gear 51 is configured in a D-shaped structure in a front view and the fitting protrusion 52B of the small-diameter gear 52 is configured in a D-shaped structure that is similar to the fitting recess portion 51D as viewed from the rear side. However, the shapes of the fitting recess portion 51D and the fitting protrusion 52B are not restricted to such a structure. For example, the fitting recess portion 51D may be configured in a rectangular shape or a track shape in a front view. Furthermore, the fitting protrusion 52B may be configured in a shape that is similar to the fitting recess portion 51D as viewed from the rear side. That is to say, the fitting recess portion 51D and the fitting protrusion 52B may preferably be configured so as to maintain the relative rotational position relation between the large-diameter gear 51 and the small-diameter gear 52 when they are coupled.

Description has been made in the present embodiment regarding an arrangement in which the head portion 52A of the operating member 42 is exposed from the cover 11 as an external component. Also, the head portion 42A may be arranged within the cover 11. Also, a cover member may be provided so as to cover the head portion 42A. In this case, an opening may be formed in the cover 11 or the cover member so as to allow the user to operate the operating member 42.

Description has been made in the present embodiment regarding an arrangement in which the whole of the needle plate 15 is formed of a magnetic material. However, the whole of the needle plate 15 is not necessarily required to be formed of such a magnetic material. That is to say, it is sufficient for each magnet 24 to be able to apply a magnetic force to the needle plate 15. Accordingly, only a part of the needle plate 15 may be formed of a magnetic material such that, when the needle plate 15 is set to the fixed state, such a part is set to a position in the vicinity of the upper face of each magnet 24. For example, the needle plate 15 may be configured as a resin plate having a structure in which a metal plate (magnetic material plate) is attached to a part of the needle plate 15, which also provides an application of the present invention. That is to say, the present invention includes an arrangement in which a part of the needle plate 15 is formed of a magnetic material.

DESCRIPTION OF THE REFERENCE NUMERALS

10 sewing machine, 10A pillar portion, 10B arm portion, 10C bed portion (sewing machine main body), 11 cover, 11A hole portion, 12 fixing plate, 13 first presser member, 13A presser tab, 14 second presser member, 14A presser tab, 15 needle plate, 16 engagement member, 16A engagement tab, 18 needle plate attaching/detaching mechanism, 20 attaching/detaching bar (needle plate fixing portion), 21 rotational shaft, 21A core portion, 21B outer shaft portion, 21B1 protrusion, 21B2 receiving face, 22 cam, 22A cam face, 23 coupling pin, 24 magnet, 30 driving mechanism, 31 base plate, 31A first through hole, 31B second through hole, 31C guide tab, 32 first shat, 33 second shaft, 34 needle plate motor (motor), 34A output shaft, 35 motor gear, 35A gear portion, 36 driving gear, 36A guide groove, 36B support shaft portion, 36C coupling cylindrical portion, 36D slit, 36E gear portion, 40 operating mechanism, 41A fixing tab, 41B fixing hole, 41C support hole, 41D support recess portion, 41E holding groove, 41F limiting groove, 41G engagement groove, 42 operating member, 42A head portion, 42B first operating shaft portion, 42C second operating shaft portion, 42D groove, 42E engagement groove, 43 positioning pin, 44 return spring, 45 manual gear, 45A fixing portion, 45B fixing hole portion, 45C pressing rib, 45D gear portion, 45E incomplete gear portion, 50 transmission mechanism, 51 large-diameter gear (first gear), 51A support hole, 51B gear portion, 51C protrusion, 51D fitting recess portion (fitting portion), 52 small-diameter gear (second gear), 52A support hole, 52B fitting protrusion (fitting target portion), 52C gear portion, 52D flange, 53 clutch mechanism, 54 clutch spring, 60 control unit, 62 operating unit, ER E-ring, SC fixing screw.

What is claimed is:

1. A sewing machine comprising a needle plate attaching/detaching mechanism, wherein the needle plate attaching/detaching mechanism comprises:

a needle plate fixing portion rotatably provided below a needle plate mounted on a sewing machine main body, and configured such that it can be moved between a fixed position at which the needle plate is fixed to the sewing machine main body and a non-fixed position at which the fixed state of the needle plate is released;

a driving gear coupled to the needle plate fixing portion such that they can be rotated as a single unit;

a motor having an output shaft to which a motor gear is provided such that they can be rotated as a single unit;

a transmission mechanism configured to be switchable between a transmission state in which a driving force from the motor is transmitted to the driving gear and a disconnection state in which the transmission is disconnected; and an operating member comprising a manual gear configured to transmit a manual operating force to the driving gear, wherein, when the operating member is not operated, the transmission mechanism is set to the transmission state, and the manual gear is disconnected from the driving gear, and wherein, when the operation member is operated, the operating member switches the transmission mechanism from the transmission state to the disconnection state, and the manual gear is coupled to the driving gear.

2. The sewing machine according to claim 1, wherein the transmission mechanism comprises:

a first gear that meshes with the motor gear; and a second gear coupled to the first gear such that they can be rotated as a single unit, and arranged such that it meshes with the driving gear, wherein the manual gear comprises:

a gear portion configured to mesh with the second gear; and an incomplete gear portion configured to avoid meshing with the second gear, and wherein, when the operating member is in a non-operating state, the incomplete gear portion provides the disconnection state in which the manual gear is disconnected from the driving gear.

3. The sewing machine according to claim 2, wherein the transmission mechanism comprises a clutch mechanism configured to couple the first gear and the second gear such that they can be rotated as a single unit, and wherein, when the operating member is operated, the operating member operates the clutch mechanism so as to release a coupling state between the first gear and the second gear.

4. The sewing machine according to claim 3, wherein the clutch mechanism comprises a fitting portion provided to the first gear and a fitting target portion provided to the second gear, wherein, when the operating member is pressed, the manual gear presses the second gear so as to release a fitting state between the fitting portion and the fitting target portion, and wherein the fitting portion is fitted within the fitting target portion only when a rotational position relation between the first gear and the second gear is set to a relation provided before the operation of the clutch mechanism.

* * * * *